US011840746B2

(12) United States Patent
Soto Medina et al.

(10) Patent No.: US 11,840,746 B2
(45) Date of Patent: Dec. 12, 2023

(54) HIGH TEMPERATURE LIGHTWEIGHT AL—FE—SI BASED ALLOYS

(71) Applicant: University of Florida Research Foundation, Inc., Gainesville, FL (US)

(72) Inventors: Sujeily Soto Medina, Gainesville, FL (US); Michele V. Manuel, Gainesville, FL (US); Richard Hennig, Gainesville, FL (US); Lilong Zhu, Gainesville, FL (US); Biswas Rijal, Gainesville, FL (US)

(73) Assignee: UNIVERSITY OF FLORIDA RESEARCH FOUNDATION, INC., Gainesville, FL (US)

( * ) Notice: Subject to any disclaimer, the term of this patent is extended or adjusted under 35 U.S.C. 154(b) by 587 days.

(21) Appl. No.: 16/933,581

(22) Filed: Jul. 20, 2020

(65) Prior Publication Data

US 2021/0017630 A1 Jan. 21, 2021

Related U.S. Application Data

(60) Provisional application No. 62/929,274, filed on Nov. 1, 2019, provisional application No. 62/876,202, filed on Jul. 19, 2019.

(51) Int. Cl.
*C22C 21/00* (2006.01)
*C22F 1/04* (2006.01)

(52) U.S. Cl.
CPC ..... *C22C 21/00* (2013.01); *C22F 1/04* (2013.01)

(58) Field of Classification Search
None
See application file for complete search history.

(56) References Cited

U.S. PATENT DOCUMENTS

2007/0243097 A1* 10/2007 Sarrazin ..... C22C 21/16 164/76.1
2019/0003029 A1* 1/2019 Oh ..... C22C 38/04

FOREIGN PATENT DOCUMENTS

JP H09279272 * 10/1997
JP 2002348649 * 12/2002
JP 2002371332 * 12/2002
JP 2016037632 * 3/2016

OTHER PUBLICATIONS

M. C. J. Marker, B. Skolyszewska-Kuhberger, H. S. Effenberger, C. Schmetterer, and K. W. Richter, "Phase equilibria and structural investigations in the system Al—Fe—Si," Intermetallics, vol. 19, No. 12, pp. 1919-1929, 2011.

F. Bosselet, S. Pontevichi, M. Sacerdote-Peronnet, and J. C. Viala, "Affinement expérimental de l'isotherme Al—Fe—Si à 1000 K," J. Phys. IV, vol. 122, pp. 41-46, 2004.

(Continued)

*Primary Examiner* — Daniel J. Schleis
(74) *Attorney, Agent, or Firm* — THOMAS | HORSTEMEYER, LLP

(57) ABSTRACT

Described herein are approaches to stabilizing AlFeSi ternary intermetallic compounds while destabilizing competing phases. The inclusion of metals such as Mn, Ni, Co, Cu, or Zn to produce quaternary systems accomplishes this problem associated with AlFeSi ternary intermetallic compounds.

15 Claims, 16 Drawing Sheets

(56) References Cited

OTHER PUBLICATIONS

V. Raghavan, "Al—Fe—Si (Aluminum-Iron-Silicon)," J. Phase Equilibria Diffus., vol. 30, No. 2, pp. 184-188, 2009.
Microstructure Evolution of the High Temperature Intermetallic Phase τ10-Al4Ee1.7Si, TMS, Mar. 13, 2018.
AlFeSi-based Intermetallic Compounds for High Temperature Applications, MS&T, Oct. 14, 2018.
Investigation of the Al—Co—Fe and Al—Cu—Fe Phase Diagrams Over the Whole Composition Range, TMS, Mar. 13, 2019.
Solubility of Ni, Co and Mn in a Lightweight Al-Based High Temperature Intermetallic Phase, TMS, Mar. 14, 2019.
Lilong Zhu , Sujeily Soto-Medina , Wesley Cuadrado-Castillo , Richard G. Hennig , Michele V. Manuel, New experimental studies on the phase diagram of the Al—Cu—Fe quasicrystal-forming system, Materials & Design 185 (2019) 108186.
Lilong Zhu, Sujeily Soto-Medina, Richard G. Hennig, Michele V. Manuel, Experimental investigation of the Al—Co—Fe phase diagram over the whole composition range, Journal of Alloys and Compounds 815 (2020) 152110.
Lilong Zhu, Shreyas Honrao, Biswas Rijal, Richard G. Hennig, Michele V. Manuel, Phase equilibria and diffusion coefficients in the Fe—Zn binary system, Materials and Design 188 (2020) 108437.
B. Mckenzie. Who drives to work? Commuting by automobile in the United States: 2013, United States Census Bureau, ACS-32, 2015.
E. Giovannetti. CAFE Standards and the federal gas tax: impact on private transit CO2 emissions, University of Iowa, 2018.
United States Environmetal Protection Agency. Light-duty automotive technology, carbon dioxide emissions, and fuel economy trends: 1975 Through 2016, EPA-420-R-16-010 (2016).
United States Environmetal Protection Agency. Final Determination on the Appropriateness of the Model Year 2022-2025 Light-Duty Vehicle Greenhouse Gas Emissions Standards under the Midterm Evaluation, EPA-420-R-17-001, 2017.
National Research Council. Effectiveness and impact of corporate average fuel economy (CAFE) standards, National Academies Press, 2002.
E. Ghassemieh. Materials in automotive application, state of the art and prospects, IntechOpen, 2011.
A. Orlowicz, M. Mróz, M. Tupaj, A. Trytek. Materials used in the automotive industry, Archives of Foundry Engineering 15 (2015) 75-78.
C.M. Tamarelli. AHSS 101: The evolving use of advanced high strength steels for automotive applications, University of Michigan, 2011.
M.K. Kulekci. Magnesium and its alloys applications in automotive industry, Int J Adv Manuf Technol 39 (2008) 851-865.
O. Faruk, J. Tjong, M. Sain. Lightweight and sustainable materials for automotive applications, CRC Press, 2017 (Loaded in 5 Parts, NPL 12 1-5).
A.A. Luo. Magnesium casting technology for structural applications, J Magnesium and Alloys 1 (2013) 2-22.
R. Hussein, D. Northwood. Improving the performance of magnesium alloys for automotive applications, WIT Trans Built Evn 137 (2014) 531-544.
R. Mitra. Structural intermetallics and intermetallic matrix composites, CRC Press, 2015 (uploaded in 3 parts).
W.O. Soboyejo, T. Srivatsan. Advanced structural materials: properties, design optimization, and applications, CRC press, 2006.
X. Li, A. Scherf, M. Heilmaier, F. Stein. The Al-rich part of the Fe—Al phase diagram, J Phase Equilib Diff 37 (2016) 162-173.
Y. Liu, X. Chong, Y. Jiang, R. Zhou, J. Feng. Mechanical properties and electronic structures of Fe—Al intermetallic, Physica B 506 (2017) 1-11.
M.C. Marker, B. Skolyszewska-Kuhberger, H.S. Effenberger, C. Schmetterer, K.W. Richter. Phase equilibria and structural investigations in the system Al—Fe—Si, Intermetallics 19 (2011) 1919-1929.
Z.Y. Liu, A.K. Sachdev. Rapidly solidified high-temperature aluminum iron silicon alloys. US Patents 2017/0211168 A1, 2017.
ASTM International. Standard terminology for additive manufacturing technologies, ASTM F2792-12a, 2012.
W.E. Frazier. Metal additive manufacturing: a review, J Mater Eng Perform 23 (2014) 1917-1928.
S.H. Huang, P. Liu, A. Mokasdar, L. Hou. Additive manufacturing and its societal impact: a literature review, Int J Adv Manuf Technol 67 (2013) 1191-1203.
W. Gao, Y. Zhang, D. Ramanujan, K. Ramani, Y. Chen, C.B. Williams, C.C.L. Wang, Y.C. Shin, S. Zhang, P.D. Zavattieri. The status, challenges, and future of additive manufacturing in engineering, Comput Aided Design 69 (2015) 65-89.
D.D. Gu, W. Meiners, K. Wissenbach, R. Poprawe. Laser additive manufacturing of metallic components: materials, processes and mechanisms, Int Mater Rev 57 (2012) 133-164.
K.V. Wong, A. Hernandez. A review of additive manufacturing, ISRN Mech Eng 2012 (2012).
M. Qian, W. Xu, M. Brandt, H. Tang. Additive manufacturing and postprocessing of Ti—6Al—4V for superior mechanical properties, MRS Bull 41 (2016) 775-784.
Y. Du, J.C. Schuster, Z.-K. Liu, R. Hu, P. Nash, W. Sun, W. Zhang, J. Wang, L. Zhang, C. Tang. A thermodynamic description of the Al—Fe—Si system over the whole composition and temperature ranges via a hybrid approach of CALPHAD and key experiments, Intermetallics 16 (2008) 554-570.
J. Scipioni Bertoli, G. Guss, S. Wu, M.J. Matthews, J.M. Schoenung. In-situ characterization of laser-powder interaction and cooling rates through high-speed imaging of powder bed fusion additive manufacturing, Mater Design 135 (2017) 385-396.
S. Gorsse, C. Hutchinson, M. Gouné,R. Banerjee. Additive manufacturing of metals: a brief review of the characteristic microstructures and properties of steels, Ti—6Al—4V and high-entropy alloys, Sci Technol Adv Mater 18 (2017) 584-610.
C. Qiu, M.A. Kindi, A.S. Aladawi, I.A. Hatmi. A comprehensive study on microstructure and tensile behaviour of a selectively laser melted stainless steel, Sci Rep 8 (2018) 7785.
A. Jain, S.P. Ong, G. Hautier, W. Chen, W.D. Richards, S. Dacek, S. Cholia, D. Gunter, D. Skinner, G. Ceder. Commentary: The Materials Project: a materials genome approach to accelerating materials innovation, APL Mater 1 (2013) 011002.
National Science and Technology Council. Materials Genome Initiative for Global Competitiveness, 2011.
S. Gražulis, D. Chateigner, R.T. Downs, A. Yokochi, M. Quiros, L. Lutterotti, E. Manakova, J. Butkus, P. Moeck, A. Le Bail. Crystallography Open Database—an open-access collection of crystal structures, J Appl Crystallogr 42 (2009) 726-729.
S. Gražulis, A. Daškevič, A. Merkys, D. Chateigner, L. Lutterotti, M. Quiros, N.R. Serebryanaya, P. Moeck, R.T. Downs, A. Le Bail. Crystallography Open Database (COD): an open-access collection of crystal structures and platform for world-wide collaboration, Nucleic Acids Res 40 (2011) D420-D427.
J .-O. Andersson, T. Helander, L. Höglund, P. Shi, B. Sundman. Thermo-Calc & DICTRA, computational tools for materials science, Calphad 26 (2002) 273-312.
G. Kresse, J. Hafner. Ab initio molecular dynamics for liquid metals, Phys Rev B 47 (1993) 558.
G. Kresse, J. Hafner. Ab initio molecular-dynamics simulation of the liquid-metal-amorphous-semiconductor transition in germanium, Phys Rev B 49 (1994) 14251.
G. Kresse, J. Furthmüller. Efficiency of ab-initio total energy calculations for metals and semiconductors using a plane-wave basis set, Comp Mater Sci 6 (1996) 15-50.
G. Kresse, J. Furthmüller. Efficient iterative schemes for ab initio total-energy calculations using a plane-wave basis set, Phys Rev B 54 (1996) 11169.
P.E. Blöchl. Projector augmented-wave method, Phys Rev B 50 (1994) 17953.
G. Kresse, D. Joubert. From ultrasoft pseudopotentials to the projector augmented-wave method, Phys Rev B 59 (1999) 1758.
J.P. Perdew, K. Burke, M. Erzerhof. Generalized gradient approximation made simple, Phys Rev Lett 77 (1996) 3865.

(56) References Cited

OTHER PUBLICATIONS

A. Jain, G. Hautier, C.J. Moore, S.P. Ong, C.C. Fischer, T. Mueller, K.A. Persson, G. Ceder. A high-throughput infrastructure for density functional theory calculations, Comp Mater Sci 50 (2011) 2295-2310.

S.P. Ong, L. Wang, B. Kang, G. Ceder. Li—Fe—P—O2 phase diagram from first principles calculations, Chem Mater 20 (2008) 1798-1807.

S.P. Ong, A. Jain, G. Hautier, B. Kang, G. Ceder. Thermal stabilities of delithiated olivine MPO4 (M=Fe, Mn) cathodes investigated using first principles calculations, Electrochem Commun 12 (2010) 427-430.

K. Mathew, A.K. Singh, J.J. Gabriel, K. Choudhary, S.B. Sinnott, A.V. Davydov, F. Tavazza, R.G. Hennig. MPInterfaces: A materials project based Python tool for high-throughput computational screening of interfacial systems, Comp Mater Sci 122 (2016) 183-190.

F.J.J. van Loo. Multiphase diffusion in binary and ternary solid-state systems, Prog Solid State Chem 20 (1990) 47-99.

V.T. Witusiewicz, F. Sommer, E.J. Mittemeijer. Reevaluation of the Fe—Mn phase diagram, J Phase Equilib and Diff 25 (2004) 346-354.

R. Thompson, J.-C. Zhao, K. Hemker. Effect of ternary elements on a martensitic transformation in β-NiAl, Intermetallics 18 (2010) 796-802.

B. Grushko, W. Kowalski, M. Surowiec. On the constitution of the Al—Co—Fe alloy system, J Alloy Compd 491 (2010) L5-L7.

* cited by examiner a)

b)

HIGH TEMPERATURE LIGHTWEIGHT AL—FE—SI BASED ALLOYS

CROSS REFERENCE TO RELATED APPLICATIONS

This application claims priority upon U.S. provisional application Ser. No. 62/929,274 filed on Nov. 1, 2019 and 62/876,202 filed on Jul. 19, 2019. These applications are hereby incorporated by reference in their entireties.

STATEMENT REGARDING FEDERALLY SPONSORED RESEARCH OR DEVELOPMENT

This invention was made with government support under Grant Number DE-EE0007742, awarded by the Department of Energy. The government has certain rights in the invention.

BACKGROUND

Transportation industries are in constant search for low-cost lightweight, high-temperature materials. The Al—Fe—Si system provides an opportunity to develop such a material, as it comprises of the three low-cost elements that are all abundant in nature. The intermetallic $\tau_{11}$-$Al_4Fe_{1.7}Si$ is of particular interest due to its low density, potential mechanical properties at high temperatures and good corrosion resistance. Although, all these promising properties its small composition range present a limitation to potential applications.

SUMMARY

Described herein are approaches to stabilizing AlFeSi ternary intermetallic compounds while destabilizing competing phases. The inclusion of metals such as Mn, Ni, Co, Cu, or Zn to produce quaternary systems accomplishes this problem associated with AlFeSi ternary intermetallic compounds.

The advantages of the invention will be set forth in part in the description which follows, and in part will be obvious from the description, or may be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

BRIEF DESCRIPTION OF THE DRAWINGS

The accompanying drawings, which are incorporated in and constitute a part of this specification, illustrate several aspects described below.

DETAILED DESCRIPTION

Figure 1:
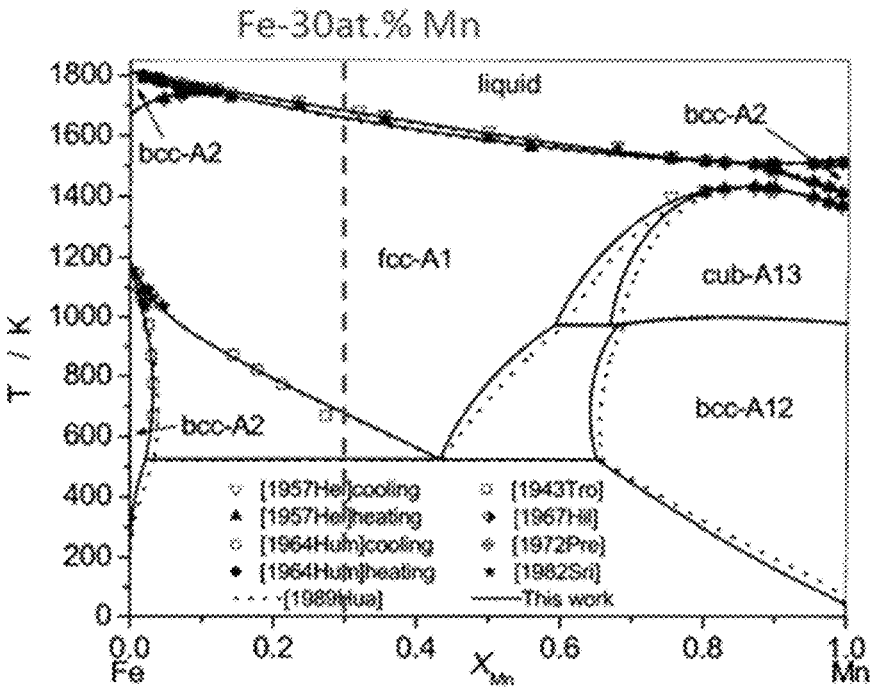
FIG. 1 shows a phase diagram of the Fe—Mn binary system proposed by Witusiewicz et al. [53].

Many modifications and other embodiments disclosed herein will come to mind to one skilled in the art to which the disclosed compositions and methods pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. The skilled artisan will recognize many variants and adaptations of the aspects described herein. These variants and adaptations are intended to be included in the teachings of this disclosure and to be encompassed by the claims herein.

Although specific terms are employed herein, they are used in a generic and descriptive sense only and not for purposes of limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure.

Any recited method can be carried out in the order of events recited or in any other order that is logically possible. That is, unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant application should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

While aspects of the present disclosure can be described and claimed in a particular statutory class, such as the system statutory class, this is for convenience only and one of skill in the art will understand that each aspect of the present disclosure can be described and claimed in any statutory class.

It is also to be understood that the terminology used herein is for the purpose of describing particular aspects only and is not intended to be limiting. Unless defined otherwise, all technical and scientific terms used herein have the same meaning as commonly understood by one of ordinary skill in the art to which the disclosed compositions and methods belong. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

Definitions

In the specification and in the claims that follow, reference will be made to a number of terms that shall be defined to have the following meanings:

It must be noted that, as used in the specification and the appended claims, the singular forms "a," "an," and "the" include plural referents unless the context clearly dictates otherwise. Thus, for example, reference to "a solvent" includes mixtures of two or more solvents and the like.

"Optional" or "optionally" means that the subsequently described event or circumstance can or cannot occur, and that the description includes instances where the event or circumstance occurs and instances where it does not.

Throughout this specification, unless the context dictates otherwise, the word "comprise," or variations such as "comprises" or "comprising," will be understood to imply the inclusion of a stated element, integer, step, or group of elements, integers, or steps, but not the exclusion of any other element, integer, step, or group of elements, integers, or steps.

As used herein, the term "about" is used to provide flexibility to a numerical range endpoint by providing that a given numerical value may be "a little above" or "a little below" the endpoint without affecting the desired result. For purposes of the present disclosure, "about" refers to a range extending from 10% below the numerical value to 10% above the numerical value. For example, if the numerical value is 10, "about 10" means between 9 and 11 inclusive of the endpoints 9 and 11.

As used herein, the term "admixing" is defined as mixing two or more components together so that there is no chemical reaction or physical interaction. The term "admixing" also includes the chemical reaction or physical interaction between the two or more components.

As used herein, a plurality of items, structural elements, compositional elements, and/or materials may be presented in a common list for convenience. However, these lists should be construed as though each member of the list is individually identified as a separate and unique member. Thus, no individual member of any such list should be construed as a de facto equivalent of any other member of the same list based solely on its presentation in a common group, without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range was explicitly recited. As an example, a numerical range of "about 1" to "about 5" should be interpreted to include not only the explicitly recited values of about 1 to about 5, but also to include individual values and sub-ranges within the indicated range. Thus, included in this numerical range are individual values such as 2, 3, and 4, the sub-ranges such as from 1-3, from 2-4, from 3-5, from about 1-about 3, from 1 to about 3, from about 1 to 3, etc., as well as 1, 2, 3, 4, and 5, individually. The same principle applies to ranges reciting only one numerical value as a minimum or maximum. The ranges should be interpreted as including endpoints (e.g., when a range of "from about 1 to 3" is recited, the range includes both of the endpoints 1 and 3 as well as the values in between). Furthermore, such an interpretation should apply regardless of the breadth or range of the characters being described.

Disclosed are materials and components that can be used for, can be used in conjunction with, can be used in preparation for, or are products of the disclosed compositions and methods. These and other materials are disclosed herein, and it is understood that when combinations, subsets, interactions, groups, etc. of these materials are disclosed, that while specific reference to each various individual combination and permutation of these compounds may not be explicitly disclosed, each is specifically contemplated and described herein. For example, if a first class of composed of A, B, and C are disclosed, as well as a second class composed of D, E, and F, and an example combination of A+D is disclosed, then even if each is not individually recited, each is individually and collectively contemplated. Thus, in this example, each of the combinations A+E, A+F, B+D, B+E, B+F, C+D, C+E, and C+F is specifically contemplated and should be considered from disclosure of A, B, and C; D, E, and F; and the example combination A+D. Likewise, any subset or combination of these is also specifically contemplated and disclosed. Thus, for example, the sub-group of A+E, B+F, and C+E is specifically contemplated and should be considered from disclosure of A, B, and C; D, E, and F; and the example combination of A+D. This concept applies to all aspects of the disclosure including, but not limited to, steps in methods of making and using the disclosed compositions. Thus, if there are a variety of additional steps that can be performed with any specific embodiment or combination of embodiments of the disclosed methods, each such composition is specifically contemplated and should be considered disclosed.

AlFeSi Stabilized Compositions

The US is becoming more reliant on cars. In 2013, about 86% of U.S. workers commuted to work by automobile and 76% of these commuters drove alone [1]. Dependence on personal transportation in the United States results in nearly 270 million vehicles were registered in the United States, which makes vehicles the majority of greenhouse gas (GHG) emissions [2]. In order to cut greenhouse gases to reduce the impacts of climate change, vehicles are being required to boost fuel efficiency. According to the report from the Environmental Protection Agency (EPA) on 2016, the average gas fuel efficiency in United States was 24.7 mpg (miles per gallon) [3]. However, the fuel efficiency standards for light-duty vehicles developed by EPA and the National Highway Traffic Safety Administration (NHTSA) are projected to increase up to 54.5 mpg in model year 2025 [4]. The National Academy of Science noted that a 10% reduction of mass results in an 8% increase in fuel efficiency [5]. Consequently, transportation industry is in a search for new lightweight materials to reduce vehicle weight and increase fuel efficiency without compromising the overall structural integrity of the vehicle. In addition, the fuel efficiency of vehicles can be significantly improved by allowing the internal combustion engines to operate at higher temperatures. Specifically, there is a need for lightweight materials that can withstand the high temperatures due to engine operation while maintaining their mechanical strength.

The materials used in automotive need to fulfil at least the following four criteria before being approved [6]: 1) Lightweight—weight reduction is still the most cost-effective means to increase fuel efficiency and reduce greenhouse gases; 2) Cost—cost is one of the most important consumer driven factors in automotive industry; 3) Safety and crashworthiness—passenger safety and vehicle crashworthiness are at the forefront of vehicle design considerations; 4) Recycling and life cycle considerations—one of the major growing concerns in all the industries including automotive. Metallic materials are responsible for about 80% of the total automobile weight [7]. Among them, steel, aluminum alloys, and magnesium alloys are three main metals currently used in vehicles.

Steel has long been the most common material used in manufacturing vehicles by automakers worldwide. Its relatively low cost, coupled with the combination of desired mechanical properties and capabilities to be fabricated into complex shapes and easily joined through welding processes, lead to its position in automotive industry [8]. The usage of steel has allowed automobile manufacturers to achieve strength and safety standards for their vehicles at lowest costs compared to other materials. Thus, steel components make up around 65% of the average vehicle. To meet the evolving requirements for safety, vehicle performance and fuel economy, different steels with various mechanical properties have been developed for automotive applications [9].

Aluminum alloys are of great interest for transportation industry because of their low density (less than half of that of steels), high specific strength (strength to weight ratio)

and good corrosion resistance. Therefore, the applications of aluminum alloys in the automobile industry is increasing greatly for 40 years, becoming the second only to steel as the most commonly used material in vehicles and providing up to 50% weight reduction compared with traditional steel structure [10]. In addition, nearly 90% of the automotive aluminum, more than a half-million tons a year, is recovered and recycled.

Magnesium is the lightest structural metal with a density (1.74 g/cm$^3$) over four times lighter than steel (7.87 g/cm$^3$) and 35% lighter than aluminum (2.7 g/cm$^3$), which allows for significant reductions in weight [11]. Towards the global trend of vehicle weight reduction, Mg alloys are particularly promising materials for automobile components. However, Mg alloys available today for automotive applications have inferior fatigue and creep strength levels compared to Al alloys, and have severe corrosion issues [11, 12]. Therefore, significant research focusing on magnesium processing, alloy development, joining, surface treatment, corrosion resistance, and mechanical properties improvement is still needed to promote its applications in automobile industry [13, 14].

Intermetallic compounds are being widely investigated for structural applications due to their high hardness and strength at elevated temperatures [15, 16]. Among them, Al-based intermetallics exhibit low density and good corrosion resistance, which are of great advantage to be applied in automotive, aerospace and nuclear industries [17]. Al—Fe intermetallic compounds, including AlFe, $Al_2Fe$, $Al_5Fe_2$ and $Al_3Fe_4$ (sometimes also referred to as $Al_3Fe$) as shown in the Al—Fe binary phase diagram proposed by Li et al. [18], have attracted consideration recently as structural materials due to their high melting temperature, superior strength and perfect combination of light weight, excellent high-temperature corrosion and oxidation resistance [19]. Al—Fe intermetallic compounds containing high Al contents are most desirable for applications towards weight reduction due to the lower density of Al (2.7 g/cm$^3$) compared with that of Fe (7.8 g/cm$^3$). Despite the weight advantages, increasing Al content sharply deteriorates the mechanical properties and results in poor ductility [20].

With the addition of Si into the Al—Fe binary system, the possibility of stabilizing a suitable crystal structure with low density and good mechanical properties increases. The Al—Fe—Si ternary system is extremely complex and consists of at least 11 binary and 11 ternary equilibrium intermetallic phases.

The $\tau_{11}$-$Al_4Fe_{1.7}Si$ intermetallic compound has a narrow compositional range, which presents a problem by making it more difficult to manufacture the compound. Previous phase stability studies via key experiments and CALPHAD approach suggest the $\tau_{11}$ phase is a high-temperature phase, which is only stable between 727 and 997° C. [31]. Stabilization of this phase at room temperature needs rapid solidification of the melted substance. In addition, the stable composition range of the $\tau_{11}$ phase is extremely small: Al-(~24.5 at. %)Fe-(9.5-11 at. %) Si [21]. Thus, any small fluctuation in composition can change the final solidification path and create an undesirable microstructure of multiple phases [22].

Described herein are approaches to stabilizing AlFeSi ternary intermetallic compounds while destabilizing competing phases such as, for example, $Al_{13}Fe_4$. The inclusion of metals such as Mn, Ni, Co, Cu, or Zn to produce quaternary systems accomplishes this problem associated with AlFeSi ternary intermetallic compounds.

In one aspect, the compositions described herein are produced by melting Al, Fe, Si, and a metal selected from the group consisting of Mn, Ni, Co, Cu, and Zn, followed by a second heating step. The components can be admixed with one another prior to melting using techniques known in the art. In one aspect, each component has a purity of at least 99.5%. The melting step can be performed using techniques known in the art such as, for example, an arc melter. The melting step can be performed once or multiple times in order to ensure homogenization of the components.

In one aspect, after the components have been melted, the composition can be further heated. In one aspect, the composition is heated at a temperature of from about 700° C. to about 1,000° C. and from about 1 hour to about 600 hours. In another aspect, the composition is heated at a temperature of from about 700° C., about 750° C., about 800° C., about 850° C., about 900° C., about 950° C., or about 1,000° C., where any value can be a lower and upper endpoint of a range (e.g., about 800° C. to about 950° C.). In another aspect, the composition can be heated for about 1 hour, about 50 hours, about 100 hours, about 150 hours, about 200 hours, about 250 hours, about 300 hours, about 350 hours, about 400 hours, about 450 hours, about 500 hours, about 550 hours, or about 600 hours, where any value can be a lower and upper endpoint of a range (e.g., about 400 hours to about 550 hours).

The compositions described herein are predominantly a single phase. In one aspect, the compositions are predominantly the $\tau_{11}$ phase. In another aspect, the compositions are from about 95% to 100% the $\tau_{11}$ phase, or about 95%, about 95.5%, about 96%, about 96.5%, about 97%, about 97.5%, about 98%, about 98.5%, about 99%, about 99.5%, or 100%. Not wishing to be bound by theory, Mn, Ni, Co, Cu, or Zn are soluble in the $\tau_{11}$ phase in order to stabilize the $\tau_{11}$ phase as well as destabilize other competing phases. Techniques such as, for example, solid-solid diffusion coupling (SSDC) and solid-liquid diffusion coupling (SLDC), can be used to determine the solubility of Mn, Ni, Co, Cu, or Zn in the $\tau_{11}$ phase.

In one aspect, Al in the compositions described herein is in the amount of from about 60.0 atomic percent to about 70.0 atomic percent, or about 60.0 atomic percent, about 60.5 atomic percent, about 61.0 atomic percent, about 61.5 atomic percent, about 62.0 atomic percent, about 62.5 atomic percent, about 63.0 atomic percent, about 63.5 atomic percent, about 64.0 atomic percent, about 64.5 atomic percent, about 65.0 atomic percent, about 65.5 atomic percent, about 66.0 atomic percent, about 66.5 atomic percent, about 67.0 atomic percent, about 67.5 atomic percent, about 68.0 atomic percent, about 68.5 atomic percent, about 69.0 atomic percent, about 69.5 atomic percent, or about 70.0 atomic percent, where any value can be a lower and upper endpoint of a range (e.g., about 63.5 atomic percent to about 68.0 atomic percent).

In one aspect, Fe in the compositions described herein is in the amount of from about 13.0 atomic percent to about 30.0 atomic percent, or about 13.0 atomic percent, about 13.5 atomic percent, about 14.0 atomic percent about, about 14.5 atomic percent 15.0 atomic percent, about 15.5 atomic percent, about 16.0 atomic percent, about 16.5 atomic percent, about 17.0 atomic percent, about 17.5 atomic percent, about 18.0 atomic percent, about 18.5 atomic percent, about 19.0 atomic percent, about 19.5 atomic percent, about 20.0 atomic percent, about 20.5 atomic percent, about 20.5 atomic percent, about 21.0 atomic percent, about 21.5 atomic percent, about 22.0 atomic percent, about 22.5 atomic percent, about 23.0 atomic percent, about 23.5 atomic percent, about 24.0 atomic percent, about 24.5 atomic percent, about 25.0 atomic percent, about 25.5 atomic percent, about 26.0 atomic percent, about 26.5 atomic, about 27.0 atomic percent, about 27.5 atomic percent, about 28.0 atomic percent, about 28.5 atomic percent, about 29.0 atomic percent, about 29.5 atomic percent, or about 30.0 atomic percent, where any value can be a lower and upper endpoint of a range (e.g., about 18.5 atomic percent to about 25.0 atomic percent).

In one aspect, Si in the compositions described herein is in the amount of from about 5.0 atomic percent to about 20.0 atomic percent, or about 5.0 atomic percent, about 5.5 atomic percent, about 6.0 atomic percent, about 6.5 atomic percent, about 7.0 atomic percent, about 7.5 atomic percent, about 8.0 atomic percent, about 8.5 atomic percent, about 9.0 atomic percent, about 9.5 atomic percent, about 10.0 atomic percent, about 10.5 atomic percent, about 10.5 atomic percent, about 11.0 atomic percent, about 11.5 atomic percent, about 12.0 atomic percent, about 12.5 atomic percent, about 13.0 atomic percent, about 13.5 atomic percent, about 14.0 atomic percent, about 14.5 atomic percent, about 15.0 atomic percent, about 15.5 atomic percent, about 16.0 atomic percent, about 16.5 atomic percent, about 17.0 atomic percent, about 17.5 atomic percent, about 18.0 atomic percent, about 18.5 atomic percent, about 19.0 atomic percent, about 19.5 atomic percent, or about 20.0 atomic percent, where any value can be a lower and upper endpoint of a range (e.g., about 8.5 atomic percent to about 15.0 atomic percent).

In one aspect, the compositions described herein include Mn. In one aspect, Mn in the compositions described herein is in the amount of from about 0.1 atomic percent to about 14.0 atomic percent, or about 0.1 atomic percent, about 0.5 atomic percent, about 1.0 atomic percent, about 1.5 atomic percent, about 2.0 atomic percent, about 2.5 atomic percent, about 3.0 atomic percent, about 3.5 atomic percent, about 4.0 atomic percent, about 4.5 atomic percent, about 5.0 atomic percent, about 5.5 atomic percent, about 6.0 atomic percent, about 6.5 atomic percent, about 7.0 atomic percent, about 7.5 atomic percent, about 8.0 atomic percent, about 8.5 atomic percent, about 9.0 atomic percent, about 9.5 atomic percent, about 10.0 atomic percent, about 10.5 atomic percent, about 11.0 atomic percent, about 11.5 atomic percent, about 12.0 atomic percent, about 12.5 atomic percent, about 13.0 atomic percent, about 13.5 atomic percent, or about 14.0 atomic percent, where any value can be a lower and upper endpoint of a range (e.g., about 0.5 atomic percent to about 5.0 atomic percent).

In one aspect, Mn is in the amount of from about 0.5 atomic percent to about 14.0 atomic percent and Si is in the amount of from about 5.0 atomic percent to about 15.0 atomic percent. In another aspect, Mn is in the amount of from about 3.0 atomic percent to about 14.0 atomic percent and Si is in the amount of from about 10.0 atomic percent to about 15.0 atomic percent.

In one aspect, the Al—Fe—Si—Mn compound is $\tau_{11}$-(61.7-64.9)Al-(24.0-12.0)Fe-(12.8-9.1)Si-(1.5-14.0)Mn. In another aspect, the Al—Fe—Si—Mn compound is $\tau_{11}$-(64.4)Al-(21.7)Fe-(10.7)Si-(3.3)Mn, $\tau_{11}$-(64.1)Al-(21.2)Fe-(10.6)Si-(4.1)Mn, $\tau_{11}$-(64.1)Al-(20.5)Fe-(10.9)Si-(4.6)Mn, $\tau_{11}$-(62.7)Al-(20.7)Fe-(11.8)Si-(4.7)Mn, $\tau_{11}$-(62.0)Al-(21.0)Fe-(12.5)Si-(4.5)Mn, $\tau_{11}$-(64.8)Al-(20.2)Fe-(10.7)Si-(4.4)Mn, $\tau_{11}$-(64.7)Al-(18.7)Fe-(10.3)Si-(6.4)Mn, $\tau_{11}$-(63.0)Al-(13.0)Fe-(10.3)Si-(13.7)Mn and $\tau_{11}$-(64.6)Al-(22.5)Fe-(10.3)Si-(2.7)Mn, $\tau_{11}$-(62.8)Al-(23.1)Fe-(9.5)Si-(4.6)Mn, $\tau_{11}$-(66.4)Al-(19.5)Fe-(8.9)Si-(5.2)Mn, $\tau_{11}$-(66.1)Al-(19.7)Fe-(9.1)Si-(5.1)Mn, $\tau_{11}$-(62.3)Al-(22.3)Fe-(10.5)Si-(4.9)Mn, $\tau_{11}$-(65.0)Al-(18.3)Fe-(11.5)Si-(5.2)Mn, or $\tau_{11}$-(62.5)Al-(23.0)Fe-(10.3)Si-(4.3)Mn.

In one aspect, the compositions described herein include Co. In one aspect, Co in the compositions described herein is in the amount of from about 0.1 atomic percent to about 8.0 atomic percent, or about 0.1 atomic percent, about 0.5 atomic percent, about 1.0 atomic percent, about 1.5 atomic percent, about 2.0 atomic percent, about 2.5 atomic percent, about 3.0 atomic percent, about 3.5 atomic percent, about 4.0 atomic percent, about 4.5 atomic percent, about 5.0 atomic percent, about 5.5 atomic percent, about 6.0 atomic percent, about 6.5 atomic percent, about 7.0 atomic percent, about 7.5 atomic percent, or about 8.0 atomic percent, where any value can be a lower and upper endpoint of a range (e.g., about 0.5 atomic percent to about 5.0 atomic percent).

In one aspect, the Al—Fe—Si—Co compound is $\tau_{11}$-(66.1-65.3)Al-(19.3-24.1)Fe-(8.0-10.5)Si-(6.6-0.1)Co. In another aspect, the Al—Fe—Si—Co quaternary intermetallic compound is $\tau_{11}$-(65.8)Al-(23.5)Fe-(9.7)Si-(1.1)Co and $\tau_{11}$-(66.1)Al-(22.4)Fe-(9.5)Si-(2.0)Co.

In one aspect, the compositions described herein include Zn. In one aspect, Zn in the compositions described herein is in the amount of from about 0.1 atomic percent to about 10.0 atomic percent, or about 0.1 atomic percent, about 0.5 atomic percent, about 1.0 atomic percent, about 1.5 atomic percent, about 2.0 atomic percent, about 2.5 atomic percent, about 3.0 atomic percent, about 3.5 atomic percent, about 4.0 atomic percent, about 4.5 atomic percent, about 5.0 atomic percent, about 5.5 atomic percent, about 6.0 atomic percent, about 6.5 atomic percent, about 7.0 atomic percent, about 7.5 atomic percent, about 8.0 atomic percent, about 8.5 atomic percent, about 9.0 atomic percent, about 9.5 atomic percent, or about 10.0 atomic percent, where any value can be a lower and upper endpoint of a range (e.g., about 0.5 atomic percent to about 5.0 atomic percent).

In one aspect, the Al—Fe—Si—Zn compound is $\tau_{11}$-(62.6-64.9)Al-(24.8-25.0)Fe-(4.7-10.0)Si-(7.9-0.2)Zn.

In one aspect, the compositions described herein include Cu. In one aspect, Cu in the compositions described herein is in the amount of from about 0.1 atomic percent to about 2.0 atomic percent, or about 0.1 atomic percent, about 0.2 atomic percent, about 0.3 atomic percent, about 0.4 atomic percent, about 0.5 atomic percent, about 0.6 atomic percent, about 0.7 atomic percent, about 0.8 atomic percent, about 0.9 atomic percent, about 1.0 atomic percent, about 1.1 atomic percent, about 1.2 atomic percent, about 1.3 atomic percent, about 1.4 atomic percent, about 1.5 atomic percent, about 1.6 atomic percent, about 1.7 atomic percent, about 1.8 atomic percent, about 1.9 atomic percent, or about 2.0 atomic percent, where any value can be a lower and upper endpoint of a range (e.g., about 0.5 atomic percent to about 1.5 atomic percent).

In one aspect, the Al—Fe—Si—Cu compound is $\tau_{11}$-(63.3-63.4)Al-(25.3-25.1)Fe-(11.3-10.7)Si-(0.1-0.9)Cu. In another aspect, the Al—Fe—Si—Cu quaternary intermetallic compound is $\tau_{11}$-(64.0)Al-(25.1)Fe-(10.7)Si-(0.2)Cu and $\tau_{11}$-(63.8)Al-(24.9)Fe-(10.6)Si-(0.7)Cu.

In one aspect, the compositions described herein include Ni in an amount greater than 2.0 atomic percent. In one aspect, Ni in the compositions described herein is in the amount of from about 2.1 atomic percent to about 4.0 atomic percent, or about 2.1 atomic percent, about 2.2 atomic percent, about 2.3 atomic percent, about 2.4 atomic percent, about 2.5 atomic percent, about 2.6 atomic percent, about 2.7 atomic percent, about 2.8 atomic percent, about 2.9 atomic percent, about 3.0 atomic percent, about 3.1 atomic percent, about 3.2 atomic percent, about 3.3 atomic percent, about 3.4 atomic percent, about 3.5 atomic percent, about 3.6 atomic percent, about 3.7 atomic percent, about 3.8 atomic percent, about 3.9 atomic percent, or about 4.0 atomic percent, where any value can be a lower and upper endpoint of a range (e.g., about 2.5 atomic percent to about 3.5 atomic percent).

The compositions described herein are useful in the manufacture of lightweight and strong structural components. The components can be mechanical or structural components in automobiles, trucks, airplanes, or aerospace applications.

The components can be manufactured using techniques known in the art. In one aspect, the component can be manufactured by additive manufacturing (AM), also referred to as 3-D printing in industry. AM is fundamentally different from "traditional" manufacturing processes, such as casting, forming, machining, and joining, to fabricate products by removing materials from a larger stock or sheet metal [23]. The definition of AM technology by ASTM [24] is "a process of joining materials to make objects from 3D model data, usually layer upon layer, as opposed to subtractive manufacturing methodologies.

The following listing of exemplary aspects supports and is supported by the disclosure provided herein.

Aspect 1: A composition comprising Al—Fe—Si—X quaternary intermetallic compound, wherein X is selected from Mn, Ni, Co, Cu, or Zn, wherein when X is Ni, the amount of Ni is greater than 2.0 atomic percent.

Aspect 2: The composition of aspect 1, wherein Al is in the amount of from about 60.0 atomic percent to about 70.0 atomic percent, Fe is in the amount of from about 13.0 atomic percent to about 30.0 atomic percent, Si is in the amount of from about 5.0 atomic percent to about 20.0 atomic percent.

Aspect 3: The composition of aspect 1, wherein X is Mn in the amount of from about 0.1 atomic percent to about 14.0 atomic percent.

Aspect 4: The composition of aspect 1, wherein X is Mn in the amount of from about 0.5 atomic percent to about 14.0 atomic percent and Si is in the amount of from about 5.0 atomic percent to about 15.0 atomic percent.

Aspect 5: The composition of aspect 1, wherein X is Mn in the amount of from about 3.0 atomic percent to about 14.0 atomic percent and Si is in the amount of from about 10.0 atomic percent to about 15.0 atomic percent.

Aspect 6: The composition of aspect 1, wherein Al—Fe—Si—X quaternary intermetallic compound is $\tau_{11}$-(61.7-64.9)Al-(24.0-12.0)Fe-(12.8-9.1)Si-(1.5-14.0)Mn.

Aspect 7: The composition of aspect 1, wherein Al—Fe—Si—X quaternary intermetallic compound is $\tau_{11}$-(64.4)Al-(21.7)Fe-(10.7)Si-(3.3)Mn, $\tau_{11}$-(64.1)Al-(21.2)Fe-(10.6)Si-(4.1)Mn, $\tau_{11}$-(64.1)Al-(20.5)Fe-(10.9)Si-(4.6)Mn, $\tau_{11}$-(62.7)Al-(20.7)Fe-(11.8)Si-(4.7)Mn, $\tau_{11}$-(62.0)Al-(21.0)Fe-(12.5)Si-(4.5)Mn, $\tau_{11}$-(64.8)Al-(20.2)Fe-(10.7)Si-(4.4)Mn, $\tau_{11}$-(64.7)Al-(18.7)Fe-(10.3)Si-(6.4)Mn, $\tau_{11}$-(63.0)Al-(13.0)Fe-(10.3)Si-(13.7)Mn and $\tau_{11}$-(64.6)Al-(22.5)Fe-(10.3)Si-(2.7)Mn, $\tau_{11}$-(62.8)Al-(23.1)Fe-(9.5)Si-(4.6)Mn, $\tau_{11}$-(66.4)Al-(19.5)Fe-(8.9)Si-(5.2)Mn, $\tau_{11}$-(66.1)Al-(19.7)Fe-(9.1)Si-(5.1)Mn, $\tau_{11}$-(62.3)Al-(22.3)Fe-(10.5)Si-(4.9)Mn, $\tau_{11}$-(65.0)Al-(18.3)Fe-(11.5)Si-(5.2)Mn, or $\tau_{11}$-(62.5)Al-(23.0)Fe-(10.3)Si-(4.3)Mn.

Aspect 8: The composition of aspect 1, wherein X is Co in the amount of from about 0.1 atomic percent to about 8.0 atomic percent.

Aspect 9: The composition of aspect 1, wherein Al—Fe—Si—X quaternary intermetallic compound is $\tau_{11}$-(66.1-65.3)Al-(19.3-24.1)Fe-(8.0-10.5)Si-(6.6-0.1)Co.

Aspect 10: The composition of aspect 1, wherein Al—Fe—Si—X quaternary intermetallic compound is $\tau_{11}$-(65.8)Al-(23.5)Fe-(9.7)Si-(1.1)Co and $\tau_{11}$-(66.1)Al-(22.4)Fe-(9.5)Si-(2.0)Co.

Aspect 11: The composition of aspect 1, wherein X is Zn in the amount of from about 0.1 atomic percent to about 10.0 atomic percent.

Aspect 12: The composition of aspect 1, wherein Al—Fe—Si—X quaternary intermetallic compound is $\tau_{11}$-(62.6-64.9)Al-(24.8-25.0)Fe-(4.7-10.0)Si-(7.9-0.2)Zn.

Aspect 13: The composition of aspect 1, wherein X is Cu in the amount of from about 0.1 atomic percent to about 2.0 atomic percent.

Aspect 14: The composition of aspect 1, wherein Al—Fe—Si—X quaternary intermetallic compound is $\tau_{11}$-(63.3-63.4)Al-(25.3-25.1)Fe-(11.3-10.7)Si-(0.1-0.9)Cu.

Aspect 15: The composition of aspect 1, wherein Al—Fe—Si—X quaternary intermetallic compound is $\tau_{11}$-(64.0)Al-(25.1)Fe-(10.7)Si-(0.2)Cu and $\tau_{11}$-(63.8)Al-(24.9)Fe-(10.6)Si-(0.7)Cu.

Aspect 16: A composition produced by the process comprising melting Al, Fe, Si, and a metal selected from the group consisting of Mn, Ni, Co, Cu, and Zn to produce a first composition, wherein when X is Ni, the amount of Ni is greater than 2.0 atomic percent;

Aspect 17: The composition of aspect 17, further comprising heating the first composition at a temperature of from about 700° C. to about 1,000° C. and from about 1 hour to about 600 hours.

Aspect 18: The article of aspect 17, wherein the component is an automotive component, an aviation component, an aerospace component, or an implant.

Aspect 19: The article of aspect 17, wherein the component is made by a 3-D printer.

Aspect 20: An article comprising a component made of the composition of any one of claims 1 to 19.

EXAMPLES

The following examples are put forth so as to provide those of ordinary skill in the art with a complete disclosure and description of how the compounds, compositions, and methods described and claimed herein are made and evaluated, and are intended to be purely exemplary and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. Numerous variations and combinations of reaction conditions (e.g., component concentrations, desired solvents, solvent mixtures, temperatures, pressures, and other reaction ranges and conditions) can be used to optimize the product purity and yield obtained from the described process. Only reasonable and routine experimentation will be required to optimize such process conditions.

Alloy Fabrication

Both Al—Fe—Si and Al—Fe—Si—X alloys were fabricated using non-consumable arc melting on a water-cooled copper hearth under an argon atmosphere. The starting materials used in this work were 99.99% Al, 99.99% Co, 99.999% Cu, 99.98% Fe, 99.98% Mn, 99.95% Mo, 99.8% Nb, 99.9% Ni, 99.99% Sn, and 99.99% Zn from Alfa Aesar. Al-50 wt. % Si master alloy from Belmont Metals was also used for melting. The alloys were re-melted at least four times to ensure homogenization. After fabrication, the alloys were placed into a furnace at temperatures ranging from 800 to 950° C. for up to 550 hours to further homogenize them. During the high temperature treatment in the furnace, the alloys were either placed in VakPak65™ 309 stainless steel foil containers or encapsulated in quartz tubes under vacuum to avoid excessive oxidation. After being removed from the furnace, the samples were quickly air quenched to freeze the microstructure that appeared at the high temperatures.

Diffusion Couple Fabrication

A diffusion couple is an assembly of two or more pieces of metal or alloy with intimate interface contact for the purposes of the extraction of key thermodynamic or kinetic values [51]. After being annealed at an elevated temperature for an extended duration of time, solid solutions and intermetallic compounds form by interdiffusion. Due to the relatively simple design, they are widely used to create effective phase diagrams base on the local equilibrium at the phase interfaces [52], and has also been used for diffusion coefficients extraction. In this work, diffusion couples were fabricated to efficiently determine the exact solubility of these nine candidate elements in the $\tau_{11}$ phase at 800° C.

Solid-Solid Diffusion Couple (SSDC)

Among the nine candidate alloying elements, X (X=Co, Cu, Mn, Mo, Nb, Ni, Ti) has a melting point much higher than the annealing temperature of 800° C. Thus, solid-solid diffusion couples (SSDCs) were utilized to quickly evaluate the solubility of an element, X, in the $\tau_{11}$ phase. These SSDCs were created by mechanically bonding $\tau_{11}$ and a pure element of Co, Cu, Mo, Nb, Ni or Ti. Since pure electrolytic Mn is very brittle, an Fe-30 at. % Mn master alloy was prepared using arc melting to fabricate the $\tau_{11}$/FeMn SSDC. The composition of this master alloy was chosen according to Fe—Mn binary phase diagram, as shown in FIG. 1 [53]. The alloy was then annealed at 950° C. for 200 h to ensure homogenization.

The surfaces of the metal blocks used to fabricate the SSDCs were ground until flat and polished to 1 μm using a lapping fixture. Kovar jigs were used to make these SSDCs. Then the assembled diffusion couple together with the Kovar jig was encapsulated individually in a quartz tube for the heat treatment at 800° C. for up to 650 h. Upon completing the diffusion annealing, the quartz tubes containing the samples were quenched in water by quickly breaking the quartz tubes inside a water tank.

Solid-Liquid Diffusion Couple (SLDC)

In this study, Sn and Zn were also selected as potential quaternary elements. Since the melting point of Sn and Zn is only 232 and 419.5° C., respectively, they were projected to be in their liquid phase region at the annealing temperature of 800° C. Therefore, two solid-liquid diffusion couples (SLDCs) of $\tau_{11}$-Sn and $\tau_{11}$-Zn were also fabricated by taking advantage of the liquid phase formation at 800° C. (above the melting points of Sn and Zn). Pure Sn (or Zn) granules were first put at the bottom of a quartz tube and a $\tau_{11}$ alloy block of dimensions 4×5×10 mm was carefully placed above these Sn (or Zn) granules. The quartz tube with Sn (or Zn) granules and $\tau_{11}$ alloy inside was sealed with back-filled high purity argon. After encapsulation, the SLDC with Sn was annealed at 400° C. for 2 h, while the SLDC with Zn was annealed at 500° C. for 2 h. Considering the relatively high diffusion coefficients of liquid phases (usually on the order of 10-9 to 10-8 $m^2/s$), the two SLDCs were annealed at 800° C. for 8 h. After the heat treatments, the two SLDCs were quickly water quenched in a water tank.

Sample Characterization

After heat treatment, the alloy and diffusion couple samples were sectioned using a low speed saw and mounted in acrylic or epoxy resins. The samples were then ground with silicon carbide paper ranging from 320 to 1200 grit, and finally polished with 1 μm $Al_2O_3$ solution to obtain a flat surface finish.

Microstructure Analysis

The microstructure of the samples was studied by an Optical Digital Microscope VHX-6000 Series from Keyence and a Tescan MIRA3 SEM. This SEM use a Schottky field emission gun ZrO/W and can operate with a voltage from 0.2 to 30 keV. The use of SEM, especially backscatter electron (BSE) imaging, allows observation of the microstructure formed in the samples.

Phase Identification

Phase identification were completed using a Panalytical Xpert Powder XRD analysis. The samples for XRD were first pulverized and were then scanned over the 2θ range from 10 to 90° with a step size of 0.16 and 30 seconds of per step. XRD peak analysis was done using High Score Plus Rietveld software from PANalytical.

Composition Measurement

Both EDAX Octane Pro EDS and Cameca SX Five FE EPMA were used to study the chemical composition of the samples fabricated and the composition of the phase present. The collected composition data helped to define the phase boundary of the $\tau_{11}$-$Al_4Fe_{1.7}Si$ phase and the solubility of quaternary additions X in the $\tau_{11}$ phase.

Results and Discussion

Composition Range of $\tau_{11}$-$Al_4Fe_{1.7}Si$ Phase

Figures 2A, 2B, 2C, 2D, 2E, 2F, 2G, 2H:
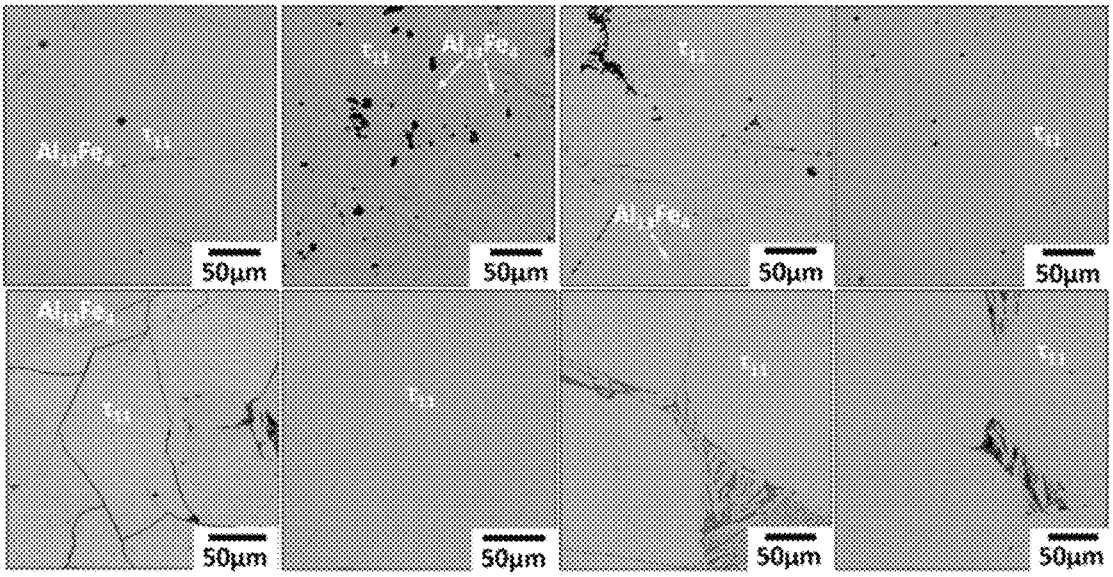
FIGS. 2(*a*)-(*h*) show SEM BSE images of eight typical Al-24.5Fe-(9.0-12.0)Si alloys: Alloys with (a) 9.0 Si, (b) 10.2 Si, (c) 11.0 Si and (d) 12.0 Si homogenized at 800° C. for 550 h; Alloys with (e) 9.0 Si, (f) 10.2 Si, (g) 11.0 Si and (h) 12.0 Si homogenized at 950° C. for 100 h. All the compositions are in at. %.

In order to determine the exact phase boundary of the $\tau_{11}$-$Al_4Fe_{1.7}Si$ phase, a series of Al—Fe—Si alloys fabricated. The compositions (all in at. %) are summarized in Table 1. These alloys were fabricated by arc melting and homogenized at 950 and 800° C. for 100 and 550 h, respectively. FIGS. 2(*a*)-(*d*) shows SEM BSE images of Al—Fe—Si alloys that were annealed at 800° C. for 550 h. It can be observed that the alloys with concentrations of Al-24.5Fe-(9.0-10.2)Si present two phases, while the alloys with concentrations of Al-24.5Fe-(11.0-12.0)Si show the $\tau_{11}$ single phase. FIGS. 2(*e*)-(*h*) shows the alloys homogenized at 950° C. for 100 h. At 950° C., a majority of the alloys show the presence of a solidified liquid phase. The compositions of the alloys fabricated, and the phases presented in these alloys after the heat treatments at both 800 and 950° C. are summarized in Table 1. The obtained experimental data revealed a compositional range of the $\tau_{11}$ phase of Al-(24.3-25.5)Fe-(8.2-10.8)Si at 800° C. and Al-(24.6-25.2)Fe-(9.6-11.0)Si at 950° C. These composition ranges of the $\tau_{11}$ single phase were used in the following diffusion couple study.

TABLE 1

Summary of the phases present in the Al—Fe—Si alloys after the heat treatments at 800 and 950° C. All the compositions are shown in at. %.

| Nominal Composition, at. % | Temperature, ° C. | Bulk Composition, at. % | Phase in equilibrium | | |
|---|---|---|---|---|---|
| Al—24.5Fe—9.0Si | 950 | Al—24.2Fe—9.0Si | $\tau_{11}$-$Al_4Fe_{1.7}Si$ | $Al_{13}Fe_4$ | |
| | 800 | Al—24.6Fe—9.0Si | $\tau_{11}$-$Al_4Fe_{1.7}Si$ | $Al_{13}Fe_4$ | |
| Al—24.5Fe—10.2Si | 950 | Al—24.7Fe—10.3Si | $\tau_{11}$-$Al_4Fe_{1.7}Si$ | | |
| | 800 | Al—24.5Fe—9.8Si | $\tau_{11}$-$Al_4Fe_{1.7}Si$ | $Al_{13}Fe_4$ | |
| Al—24.5Fe—11.0Si | 950 | Al—23.9Fe—11.5Si | $\tau_{11}$-$Al_4Fe_{1.7}Si$ | Liquid | |
| | 800 | Al—23.9Fe—10.6Si | $\tau_{11}$-$Al_4Fe_{1.7}Si$ | $Al_{13}Fe_4$ | |
| Al—24.5Fe—12.0Si | 950 | Al—23.9Fe—11.4Si | $\tau_{11}$-$Al_4Fe_{1.7}Si$ | Liquid | |
| | 800 | Al—25.0Fe—11.4Si | $\tau_{11}$-$Al_4Fe_{1.7}Si$ | | |
| Al—25.0Fe—10.5Si | 950 | Al—24.7Fe—10.1Si | $\tau_{11}$-$Al_4Fe_{1.7}Si$ | $Al_{13}Fe_4$ | |
| | 800 | Al—26.7Fe—10.4Si | $\tau_{11}$-$Al_4Fe_{1.7}Si$ | $Al_{13}Fe_4$ | $\tau_1$ |
| Al—25.0Fe—11.0Si | 950 | Al—25.1Fe—10.3Si | $\tau_{11}$-$Al_4Fe_{1.7}Si$ | | |
| | 800 | Al—26.7Fe—11.9Si | $\tau_{11}$-$Al_4Fe_{1.7}Si$ | $Al_{13}Fe_4$ | $\tau_1$ |
| Al—25.5Fe—11.5Si | 950 | Al—25.4Fe—11.0Si | $\tau_{11}$-$Al_4Fe_{1.7}Si$ | | |
| | 800 | Al—27.1Fe—11.5Si | $\tau_{11}$-$Al_4Fe_{1.7}Si$ | $Al_{13}Fe_4$ | $\tau_1$ |
| Al—26.0Fe—9.0Si | 950 | Al—25.0Fe—8.7Si | $\tau_{11}$-$Al_4Fe_{1.7}Si$ | $Al_{13}Fe_4$ | |
| | 800 | Al—25.9Fe—10.4Si | $\tau_{11}$-$Al_4Fe_{1.7}Si$ | $Al_{13}Fe_4$ | $\tau_1$ |

Figure 3:
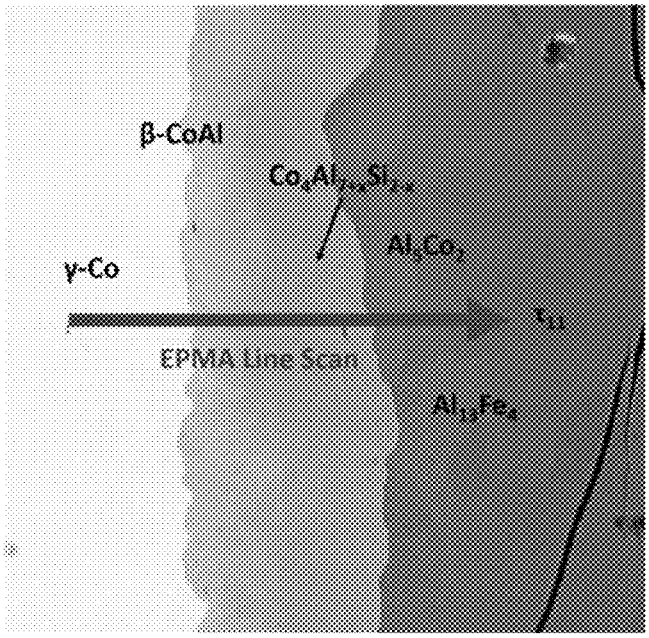
FIG. 3 shows SEM BSE image taken from the $\tau_{11}$/C SSDC annealed at 800° C. for 500 h, showing the phase formation by interdiffusion and the EPMA line scan location.
Figure 4:
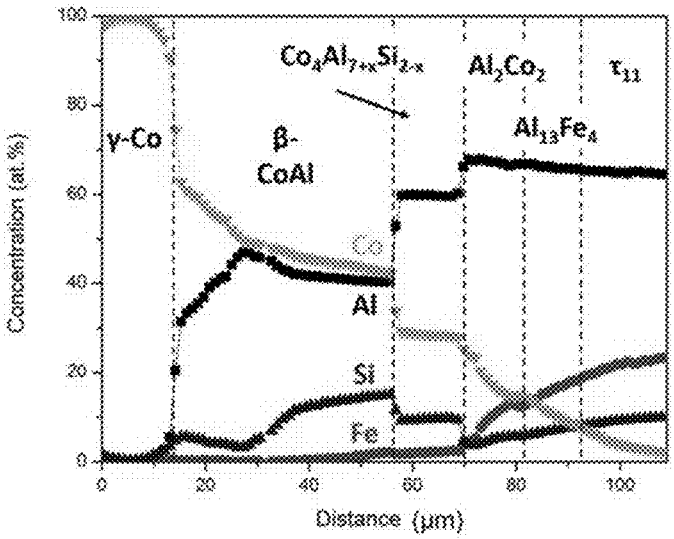
FIG. 4 shows EPMA composition profiles collected by performing an EPMA line scan across the phase interfaces between Co and $\tau_{11}$. The vertical dashed lines show the locations of phase interfaces.

Solubility of Quaternary Elements in the $\tau_{11}$-$Al_4Fe_{1.7}Si$ Phase $\tau_{11}$/CO SSDC FIG. 3 is an SEM BSE image taken from the $\tau_{11}$/Co SSDC, showing the phase formation in the diffusion region. Three layers between pure Co and $\tau_{11}$ phase were observed, which were identified to be β-CoAl, $Co_4Al_{7+x}Si_{2-x}$ and $Al_{13}Fe_4$ phases based on the EPMA/EDS composition analysis and the corresponding binary and ternary phase diagrams. Across these phase interfaces, a quantitative EPMA line scan with a step size of 1 μm was performed. The line scan location, as a red line with a right arrow showing the direction, is superimposed on the diffusion region in FIG. 3. The measured composition profiles are plotted in FIG. 4, from which the solubility of Co in Ti was defined to be 6.6 at. % at 800° C. In addition, the Co replaces Fe while the Al and Si contents in the $\tau_{11}$ phase exhibit little change.

$\tau_{11}$/CU SSDC

Figure 5:
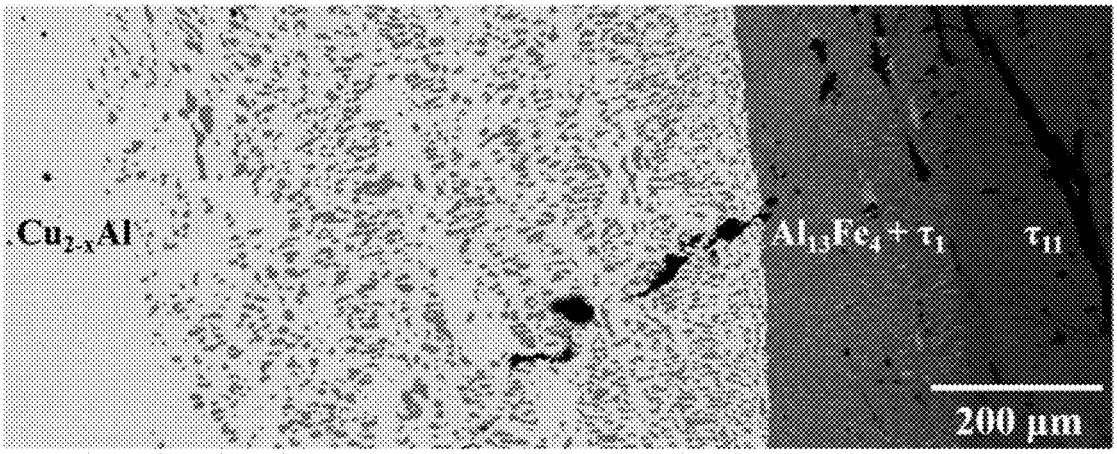
FIG. 5 show SEM BSE images taken from the AlFeSi ($\tau_{11}$+$Al_{13}Fe_4$)/$Cu_{2-x}Al$ SSDC annealed at 800° C. for 350 h, showing the phase formation by interdiffusion.
Figure 6:
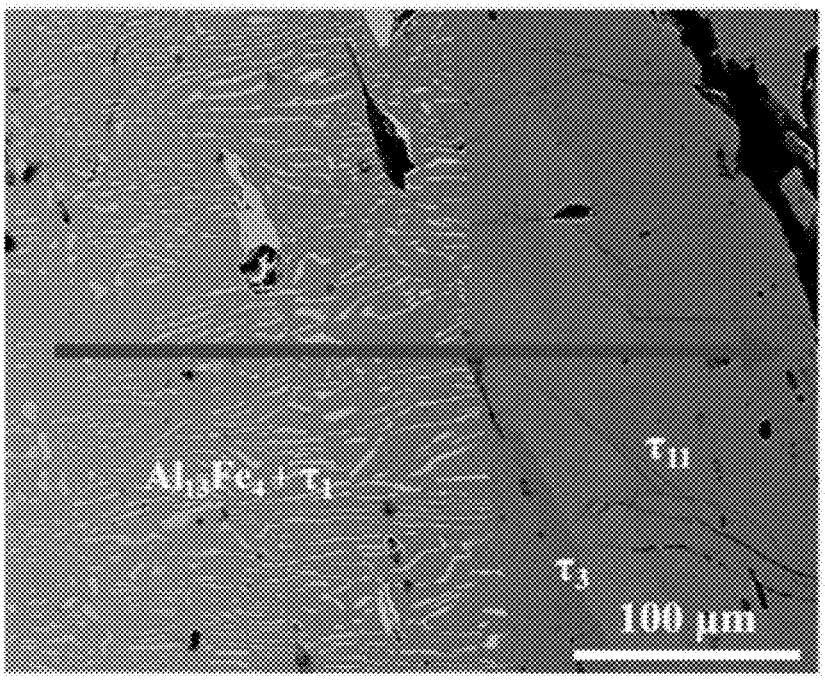
FIG. 6 shows high-magnification SEM BSE image showing the phase interface between the $Al_{13}Fe_4$ and $\tau_{11}$ phases, as well as the EPMA line scan location.
Figure 7:
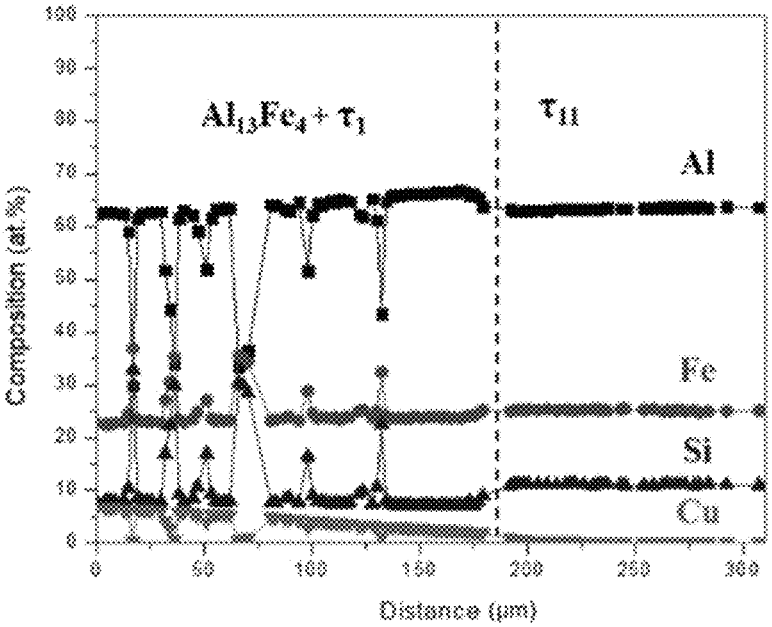
FIG. 7 shows EPMA composition profiles collected by performing an EPMA line scan across the phase interface between the $Al_{13}Fe_4$ and $\tau_{11}$ phases. The vertical dashed line shows the location of phase interface.

FIG. 5 shows the microstructure of the diffusion region taken from the $\tau_{11}$/Cu SSDC that was annealed at 800° C. for 350 h. All the phases formed in the diffusion region are labeled according to the EPMA/EDS composition analysis and its corresponding phase diagrams. One can clearly see some cracks and holes, especially close to the brittle $\tau_{11}$ alloy, which were very likely formed during the water quench process after the diffusion annealing. Otherwise the large amount of interdiffusion would not have taken place. Therefore, the cracks and holes should not affect the local phase equilibria that were reached during the diffusion annealing. An EPMA line scan was performed across the phase interface between the $Al_{13}Fe_4$ and $\tau_{11}$ phases. The line scan location and the measured composition profiles are plotted as shown in FIG. 6 and FIG. 7, respectively. From the composition profiles, the solubility of Cu in $\tau_{11}$ is extremely low, only ~0.9 at. % at 800° C.

$\tau_{11}$/FeMn SSDC

Figures 8A, 8B, 8C, 8D:
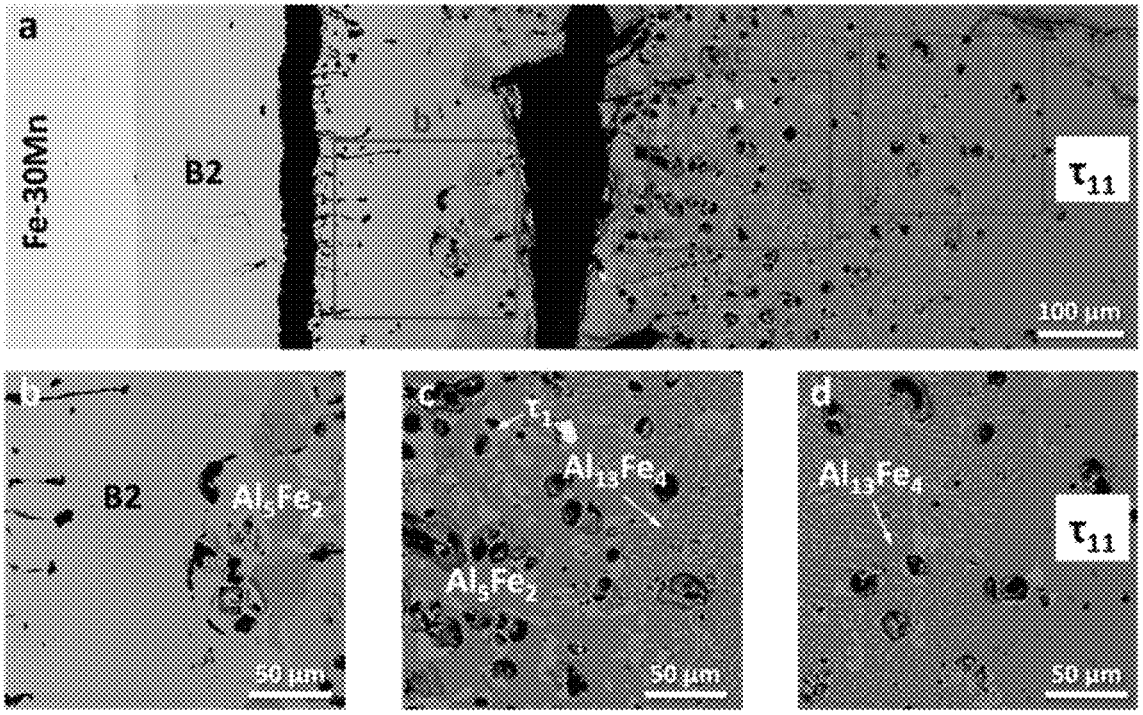
FIG. 8(*a*)-(*d*) shows SEM BSE images taken from the $\tau_{11}$/FeMn SSDC annealed at 800° C. for 8 h, showing the phase formation by interdiffusion: (a) Low-magnification image showing the entire diffusion region; (b), (c) and (d) High-magnification image of the three red box locations in (a).
Figure 9:
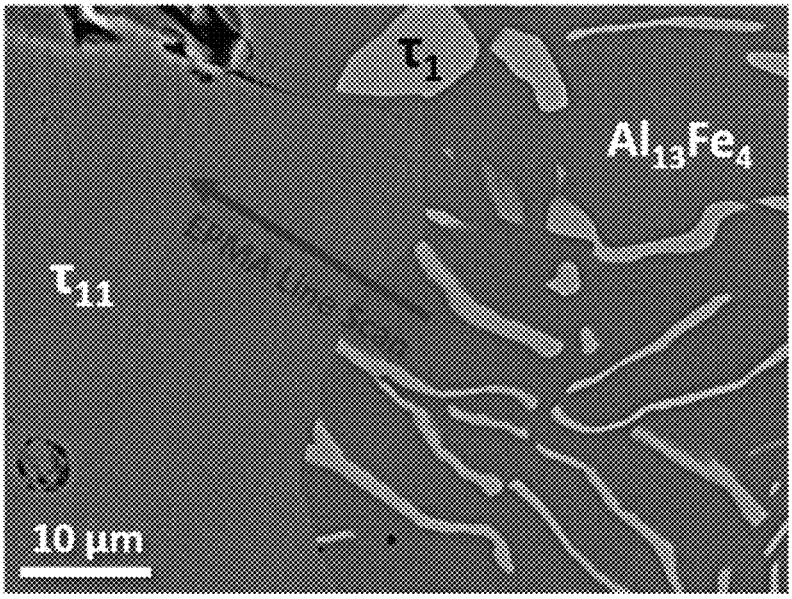
FIG. 9 shows high-magnification SEM BSE image showing the phase interface between the $Al_{13}Fe_4$ and $\tau_{11}$ phases, as well as the EPMA line scan location.
Figure 10:
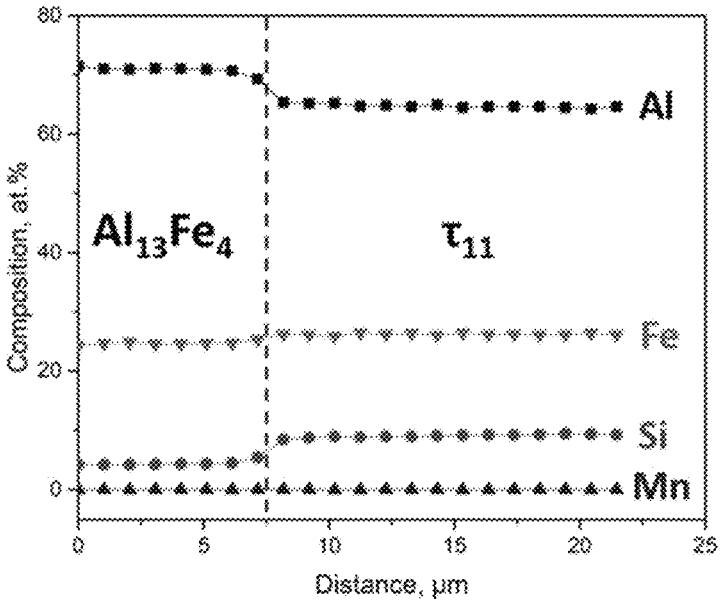
FIG. 10 shows EPMA composition profiles collected by performing an EPMA line scan across all the $Al_{13}Fe_4$/$\tau_{11}$ phase interface. The vertical dashed lines show the location of phase interface.

The $\tau_{11}$/FeMn SSDC was made and heat treated at 800° C. for 310 h. The microstructure of the diffusion region formed during the annealing heat treatment is shown in FIG. 8. Based on EDS composition measurement and corresponding phase diagrams, all the phases were well identified and labeled, FIG. 8. FIG. 9 is a high-magnification SEM BSE image showing the phase interface between the $Al_{13}Fe_4$ and $\tau_{11}$ phases. Concentration profiles obtained by performing an EPMA line scan across this phase interface are plotted in FIG. 10. As can be observed, the solubility of Mn in the $\tau_{11}$ phase is almost zero.

$\tau_{11}$/MO SSDC

Figure 11:
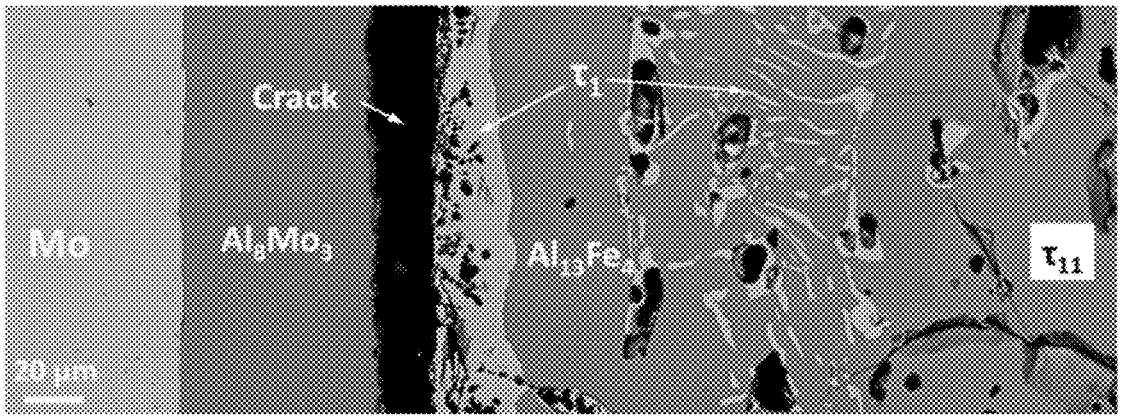
FIG. 11 shows SEM BSE image taken from the $\tau_{11}$/Mo SSDC annealed at 800° C. for 650 h, showing the phase formation by interdiffusion.

The microstructure of the diffusion region taken from the $\tau_{11}$/MO SSDC annealed at 800° C. for 650 h is shown in FIG. 11. It can be clearly seen that three phase layers of $Al_8Mo_3$, $\tau_1$ and $Al_{13}Fe_4$ have formed between pure Mo and $\tau_{11}$ alloy. EDS point analysis was used to measure the compositions near the phase interface between $Al_{13}Fe_4$ and $\tau_{11}$. We could conclude that Mo is not soluble in these two phases since no existence of Mo in either $Al_{13}Fe_4$ or $\tau_{11}$ phase was detected by EDS.

$\tau_{11}$/Nb SSDC

Figure 12:
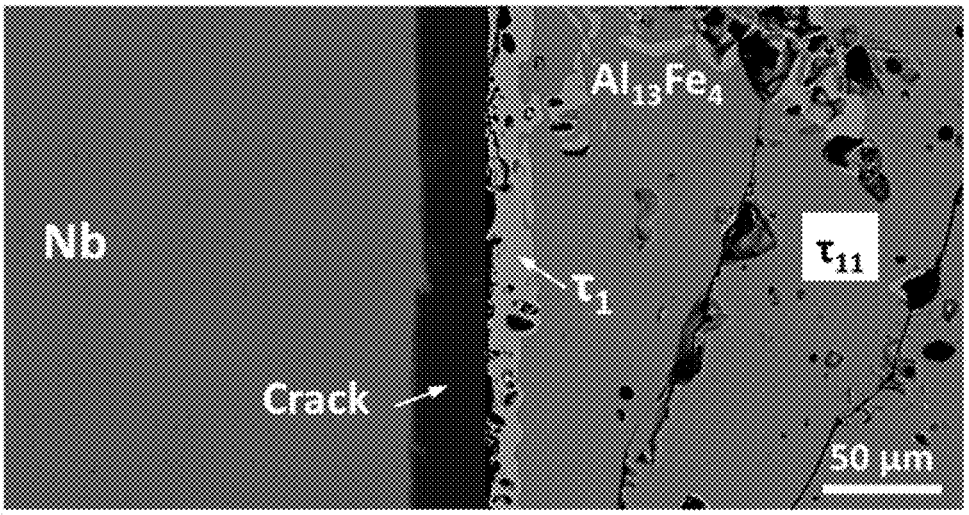
FIG. 12 shows SEM BSE image taken from the $\tau_{11}$/Nb SSDC annealed at 800° C. for 650 h, showing the phase formation by interdiffusion.

FIG. 12 is an SEM BSE taken from the $\tau_{11}$/Nb SSDC annealed at 800° C. for 650 h. Similar to the $\tau_{11}$/MO SSDC, no existence of Nb in either $Al_{13}Fe_4$ or $\tau_{11}$ phase was detected by EDS. Thus, Nb is also not soluble in these two phases.

$\tau_{11}$/Ni SSDC

Figure 13:
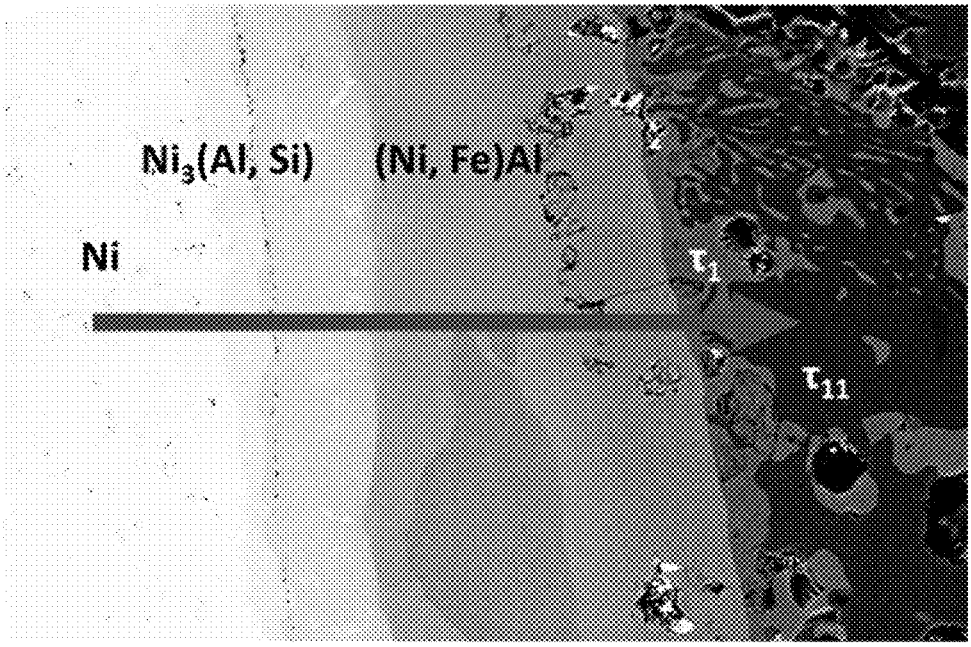
FIG. 13 shows SEM BSE image taken from the $\tau_{11}$/Ni SSDC annealed at 800° C. for 650 h, showing the phase formation by interdiffusion.
Figure 14:
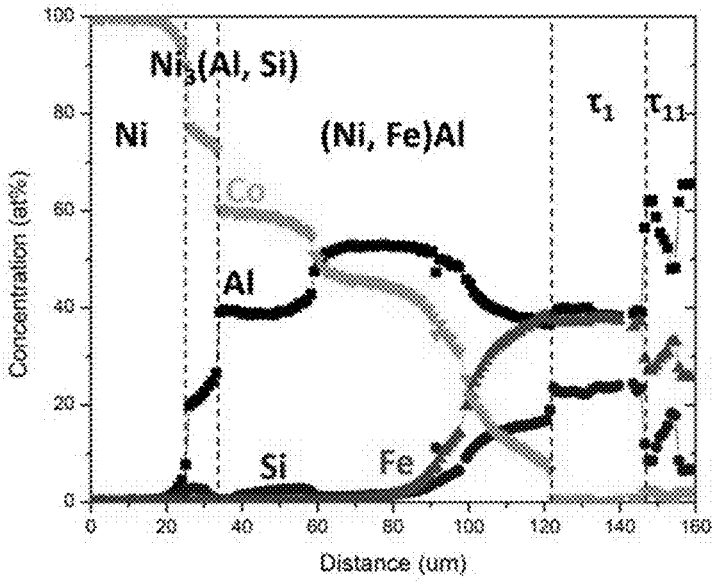
FIG. 14 shows EPMA composition profiles collected by performing an EPMA line scan across all the phase interfaces. The vertical dashed lines show the locations of phase interfaces.

FIG. 13 is an SEM BSE taken from the $\tau_{11}$/Ni SSDC annealed at 800° C. for 336 h. Three phase layers formed in the diffusion region between pure Ni and $\tau_{11}$ alloy, which were identified to be γ'-Ni(Al, Si), β-(Ni, Fe)Al and $\tau_{11}$ phases based on the EPMA/EDS composition analysis and the corresponding phase diagrams. The abrupt change of contrast on the left side of the β-(Ni, Fe)Al phase layer is due to the very sharp composition gradient near the line of the contrast change. Such an abrupt change of contrast in the p phase has been observed before in binary Ni—NiAl [54, 55] and ternary Co—Ni—CoAl and Co—Ni—NiAl diffusion couples [56]. FIG. 14 plots the composition profiles collected by performing an EPMA line scan across all the phase interfaces. The solubility of Ni in $\tau_{11}$ was extracted to be 2 at. % at 800° C., predominately replacing Si while the Al and Fe contents change only slightly.

$\tau_{11}$/Ti SSDC

Figure 15:
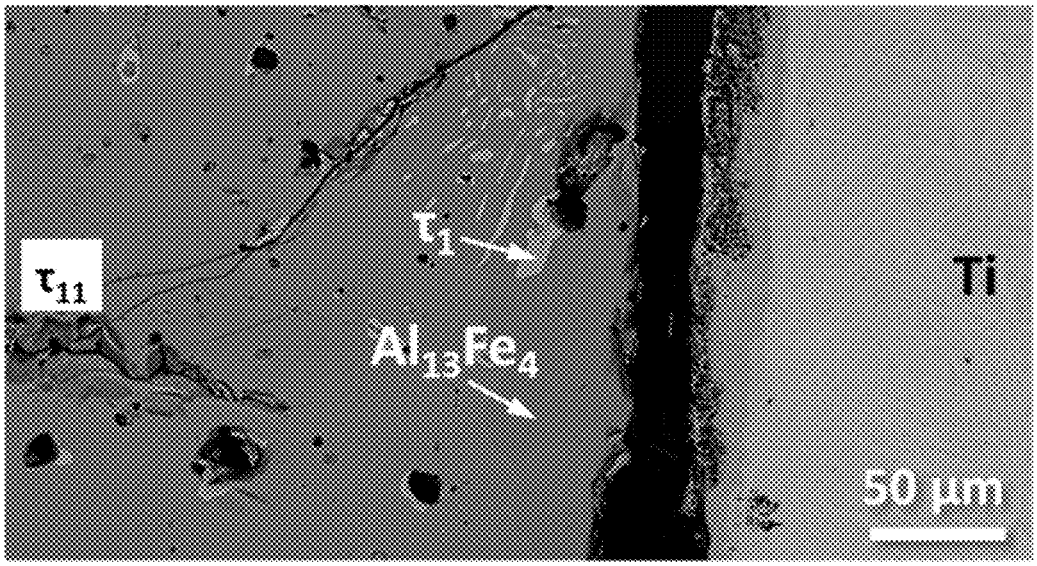
FIG. 15 shows SEM BSE image taken from the $\tau_{11}$/Ti SSDC annealed at 800° C. for 310 h, showing the phase formation by interdiffusion.
Figure 16:
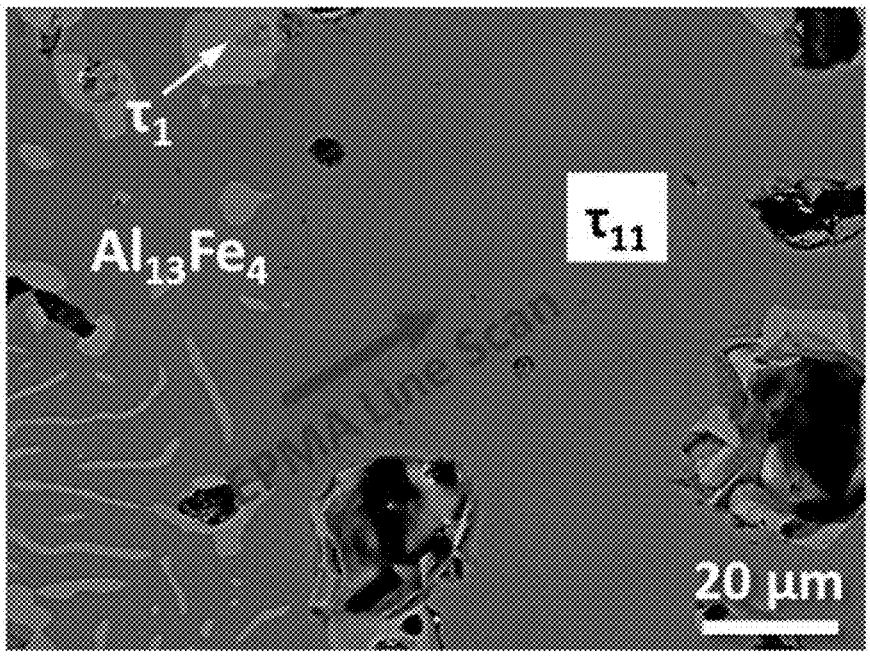
FIG. 16 shows high-magnification SEM BSE image showing the phase interface between the $Al_{13}Fe_4$ and $\tau_{11}$ phases, as well as the EPMA line scan location.
Figure 17:
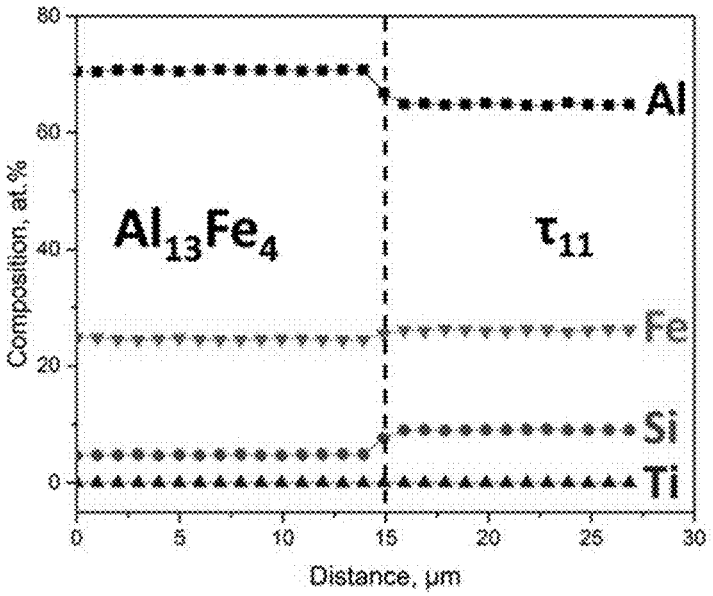
FIG. 17 EPMA composition profiles collected by performing an EPMA line scan across the $Al_{13}Fe_4$/$\tau_{11}$ phase interface. The vertical dashed lines show the location of phase interface.

FIG. 15 shows the microstructure of the diffusion region taken from the $\tau_{11}$/Ti SSDC that was annealed at 800° C. for 310 h. The phase interface between the $Al_{13}Fe_4$ and $\tau_{11}$ phases can be clearly defined in this BSE image. An EPMA line scan, with the location shown in FIG. 16, was performed across the phase interface. The collected composition profiles were plotted in FIG. 17, which indicate Ti has no solubility in the $\tau_{11}$ phase.

$\tau_{11}$/Sn SLDC

Figures 18A, 18B, 18C, 18D:
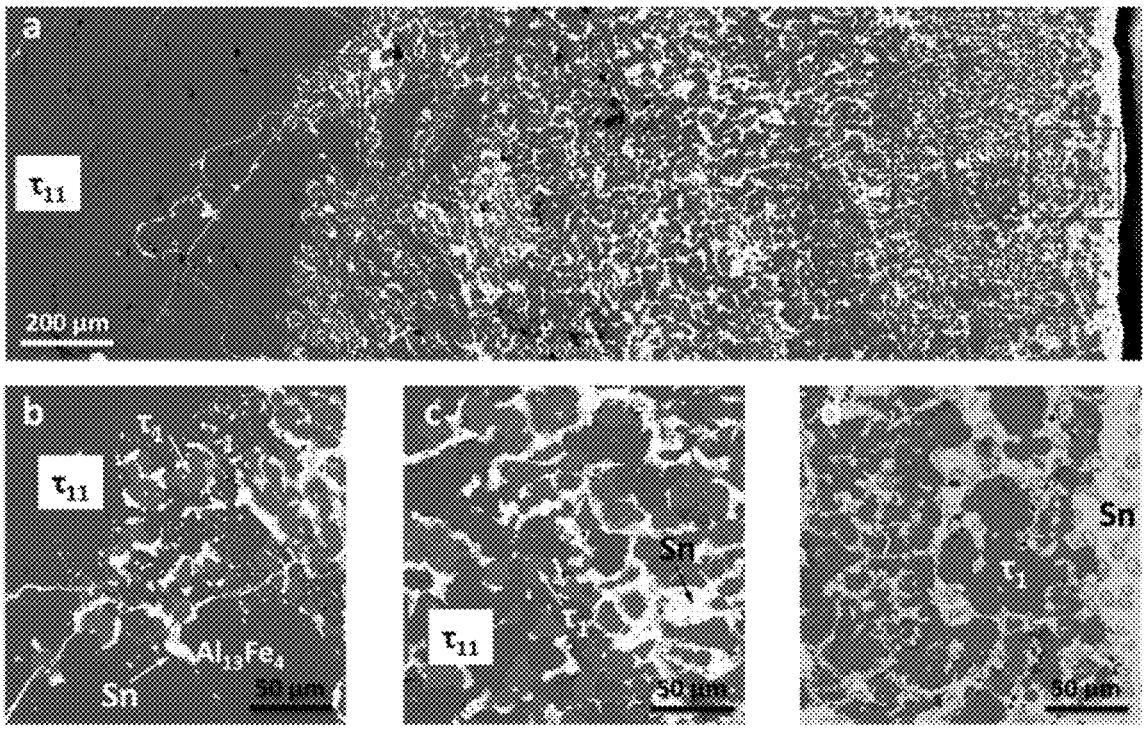
FIGS. 18(*a*)-(*d*) shows SEM BSE images taken from the $\tau_{11}$/Sn SLDC annealed at 800° C. for 8 h, showing the phase formation by interdiffusion: (a) Low-magnification image showing the entire diffusion region; (b), (c) and (d) High-magnification image of the three red box locations in (a).

FIG. 18 shows the microstructure of the diffusion region formed in the $\tau_{11}$/Sn SLDC. All the phases were identified based on EDS composition measurement and labeled in FIG. 18. No solubility of Sn in the $\tau_{11}$ phase was determined by EDS. Thus, Sn is not a promising alloying element that can be added in $\tau_{11}$ alloys.

$\tau_{11}$/Zn SLDC

Figures 19A, 19B, 19C, 19D:
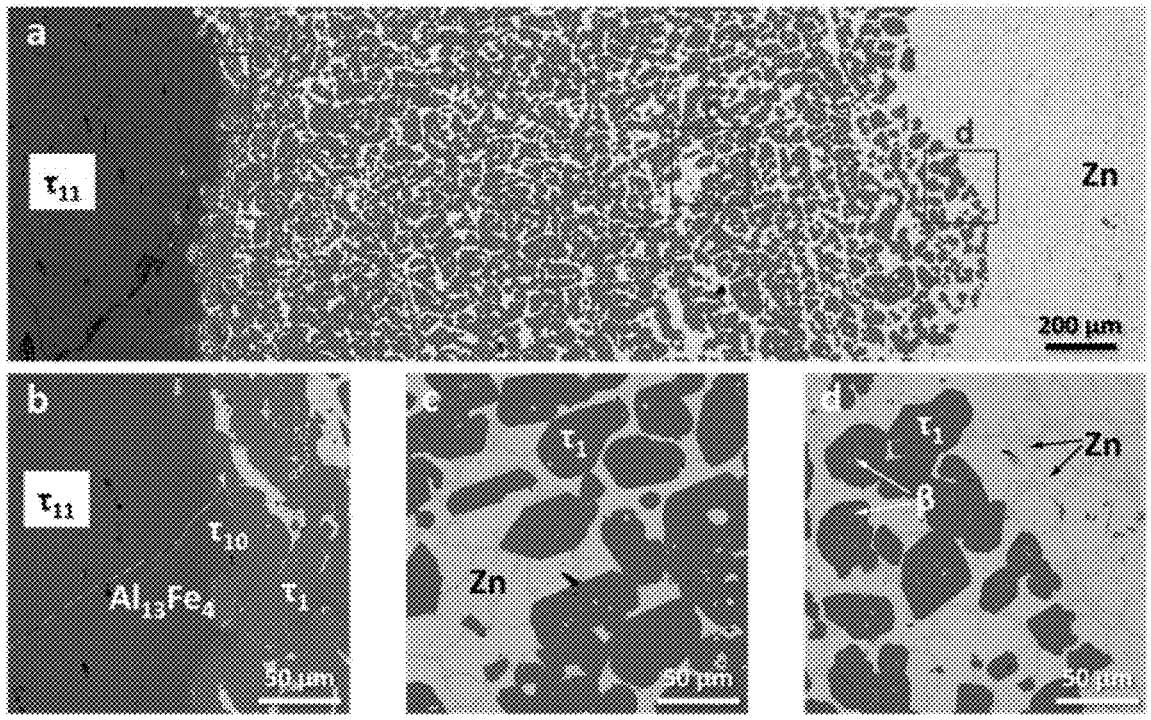
FIGS. 19(*a*)-(*d*) show SEM BSE images taken from the $\tau_{11}$/Zn SLDC annealed at 800° C. for 8 h, showing the phase formation by interdiffusion: (a) Low-magnification image showing the entire diffusion region; (b), (c) and (d) High-magnification image of the three red box locations in (a).
Figure 20:
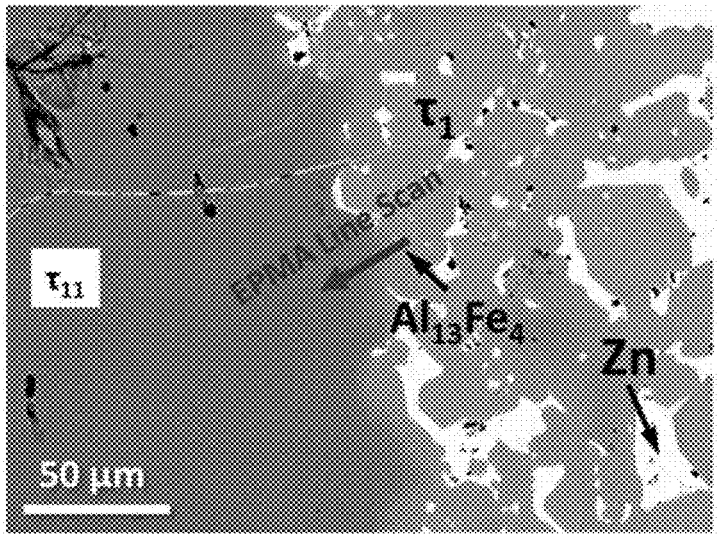
FIG. 20 shows high-magnification SEM BSE image showing the phase interface between the $Al_{13}Fe_4$ and $\tau_{11}$ phases, as well as the EPMA line scan location.
Figure 21:
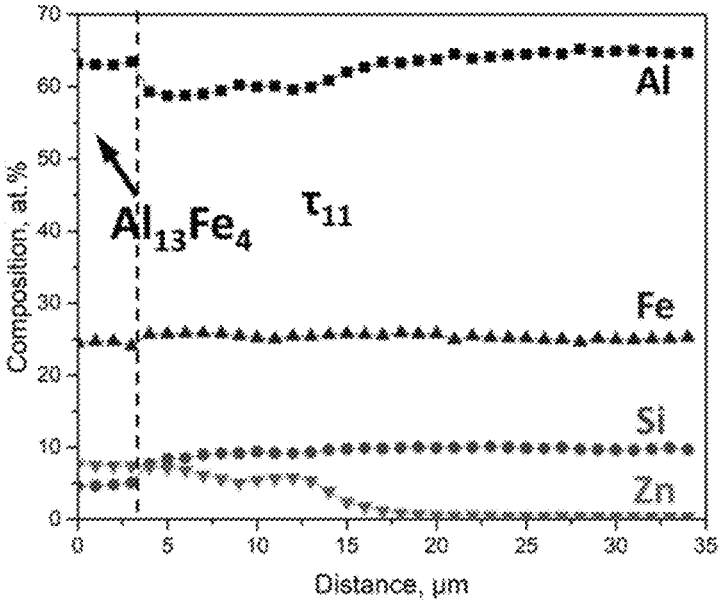
FIG. 21 shows EPMA composition profiles collected by performing an EPMA line scan across the $Al_{13}Fe_4$/$\tau_{11}$ phase interface. The vertical dashed lines show the location of phase interface.

Similarly, Zn has a low melting point of 419.5° C., and thus, a novel $\tau_{11}$/Zn SLDC was also made to measure its solubility in the $\tau_{11}$ phase. An SEM BSE image taken from this SLDC is shown in FIG. 19, wherein the solidified Zn and intermetallic phases formed by interdiffusion can be clearly identified. FIG. 20 is a high-magnification SEM BSE image showing the phase interface between the $Al_{13}Fe_4$ and $\tau_{11}$ phases. A quantitative EPMA line scan was performed across this interface, and the obtained concentration profiles are plotted in FIG. 21. The results indicate Zn has a relatively high solubility of 7.2 at. % in the $\tau_{11}$ phase at 800° C. Moreover, Zn addition in $\tau_{11}$ primarily replaces Al while the contents of Fe and Si are almost constant.

Al—Fe—Si—(Co, Ni, or Mn) Selected Quaternary Alloys

Based on the experimental results from alloy samples and diffusion couples, Co and Ni were selected as the most promising alloying elements with the potential to expend the composition range of the $\tau_{11}$-$Al_4Fe_{1.7}Si$ phase. The measured solubility of Co and Ni in $\tau_{11}$ at 800° C. is 3.5 and 2.0 at. %, respectively. Although, no solubility of Mn in $\tau_{11}$ was determined, Mn was selected as a candidate alloying element, since it may form the $\tau_8$-$Al_9Mn_3Si$ phase, which has the same crystal structure with the $\tau_{11}$ phase. Therefore, six $\tau_{11}$ alloys with Co, Mn and Ni as quaternary additions were fabricated by arc melting. The alloys were then sealed in VakPak65™ 309 stainless steel foil containers and annealed at either 900° C. for 150 h or 800° C. for 400 h. SEM, especially BSE imaging were used to observe the microstructure of the heat-treated alloys. Meanwhile, the phase present in each alloy was identified based on composition analysis using EDS.

8.3.1 Al—Fe—Si—Co Alloys

Figures 22A, 22B:
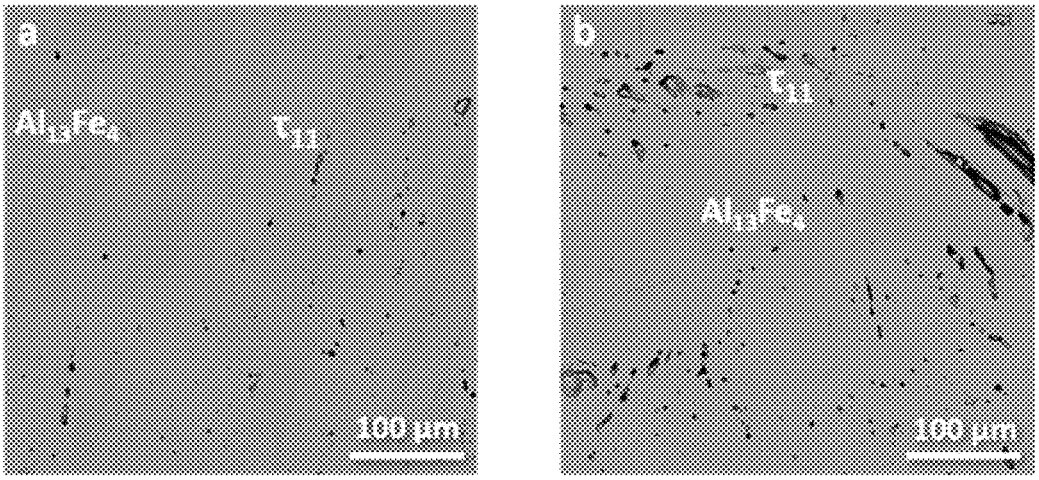
FIGS. 22(*a*)-(*b*) show SEM BSE images taken from the $\tau_{11}$ alloys with Co additions that were annealed at 800° C. for 400 h: (a) Al-23.5Fe-10.2Si-1.0Co and (b) Al-22.5Fe-10.2Si-2.0Co. The compositions are all in at. %.
Figures 23A, 23B:
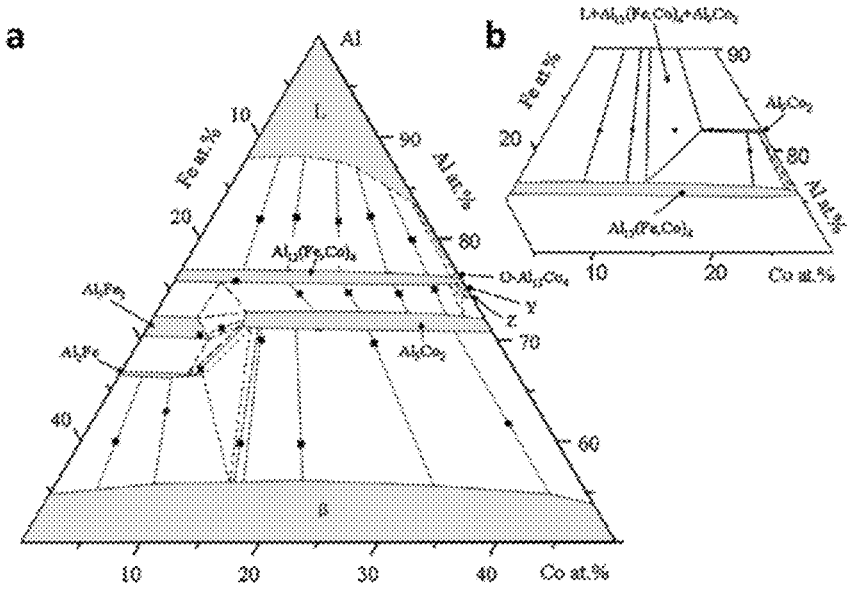
FIGS. 23(*a*)-(*b*) show partial isothermal sections of Al—Fe—Co ternary system [57] at: (a) 1070° C. and (b) 800° C.

Since the solubility of Co in $\tau_{11}$ is measured to be 3.5 at. % at 800° C., two Al—Fe—Si—Co alloys with nominal compositions of Al-23.5Fe-10.2Si-1.0Co and Al-22.5Fe-10.2Si-2.0Co (in at. %) were thus fabricated. FIG. 22 is SEM BSE images showing the microstructures after the heat treatment at 800° C. for 400 h. As can be observed, the completing $Al_{13}Fe_4$ phase coexists with the $\tau_{11}$ phase in both alloys. This can be due to the high solubility of Co in this binary $Al_{13}Fe_4$ intermetallic. This can be presumed from the experimentally measured Al—Fe—Co ternary phase diagram, FIG. 23 [57], wherein $Al_{13}Fe_4$ and M-$Al_{13}Co_4$ forming a continuous solid solution region. In the Al—Fe—Si—Co quaternary system, Co still have a very high solubility, from 3.9 to 18.7 at. % (FIG. 4), in the $Al_{13}Fe_4$ phase. Such a high solubility of Co in $Al_{13}Fe_4$ makes Co a poor candidate for the destabilization of this intermetallic.

Al—Fe—Si—Mn Alloys

Figures 24A, 24B:
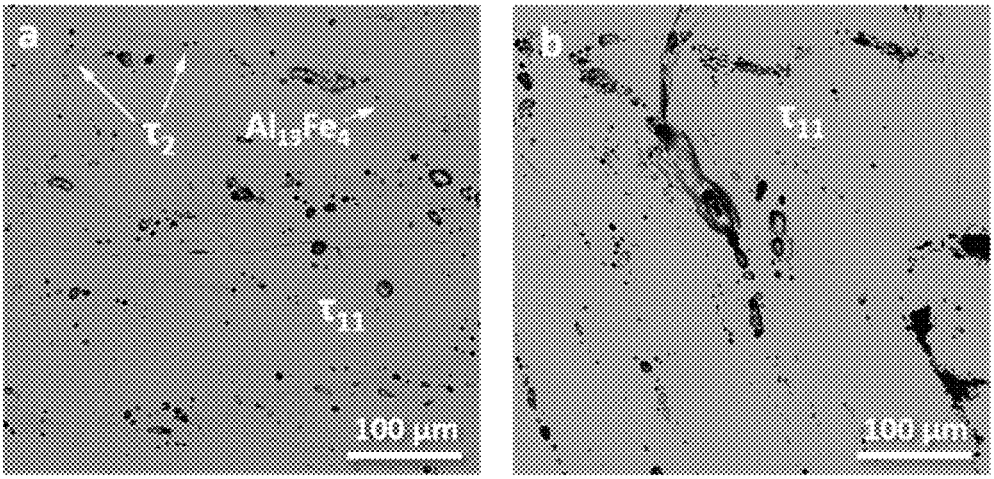
FIGS. 24(*a*)-(*b*) show SEM BSE images taken from the $\tau_{11}$ alloys with Mn additions that were annealed at 800° C. for 400 h: (a) Al-23.0Fe-11.0Si-1.5Mn and (b) Al-20.0Fe-11.0Si-4.5Mn. The compositions are all in at. %.

Two Al—Fe—Si—Mn alloys with 1.5 at. % and 4.5 at. % Mn were fabricated and annealed at 800° C. for 400 h. The microstructures of both alloys are shown in FIG. 24. As can be seen, the alloy with 1.5 at. % Mn addition is a mixture of $\tau_{11}$ phase and a very small amount of $\tau_2$ and $Al_{13}Fe_4$ phases, while the alloy with 4.5 at. % Mn is a complete $\tau_{11}$ single phase. These results suggest that Mn is a promising quaternary alloying addition that can be used to destabilize the $Al_{13}Fe_4$ phase. As mentioned above, no solubility of Mn in $\tau_{11}$ was determined by performing EPMA on the $\tau_{11}$/Fe-30 at. % Mn diffusion couple annealed at 800° C. for 310 h, FIG. 10. We speculated this happened due to the formation of a wide layer of $Al_{13}Fe_4$ and $\tau_1$ mixture (FIG. 8), which prevented the diffusion of Mn into $\tau_{11}$ alloy. According to the results from the two Al—Fe—Si—Mn alloy samples, Mn has a high solubility in $\tau_{11}$ and Mn is substituting for Fe in the $\tau_{11}$ phase.

Al—Fe—Si—Ni Alloys

Figures 25A, 25B:
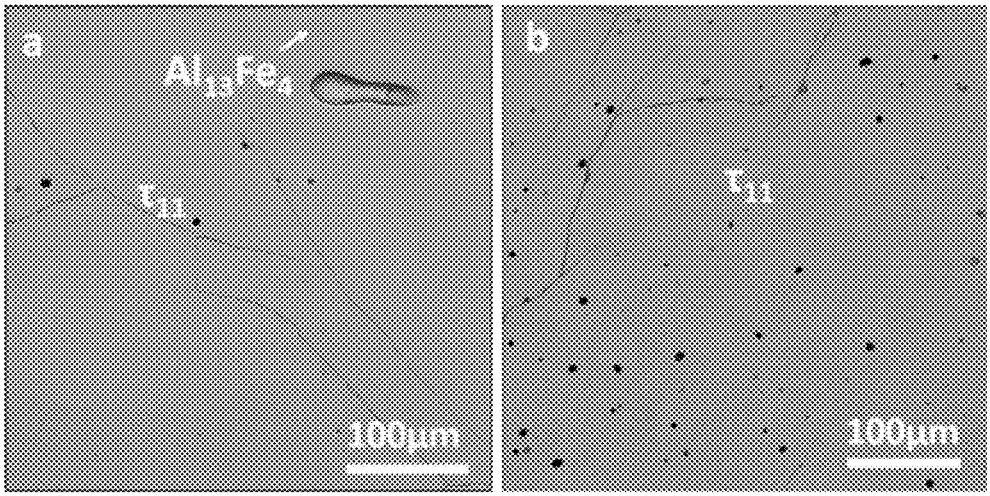
FIGS. 25(*a*)-(*b*) show SEM BSE images taken from the $\tau_{11}$ alloys with Ni additions that were annealed at 900° C. for 150 h: (a) Al-24.5Fe-9.2Si-1.0Ni and (b) Al-24.5Fe-8.2Si-2.0Ni. The compositions are all in at. %.

Ni has a solubility of 2.0 at. % in $\tau_{11}$ at 800° C., and Ni addition mainly replaces Si. Two alloys with nominal compositions of Al-24.5Fe-9.2Si-1.0Ni and Al-24.5Fe-8.2Si-2.0Ni were cast and then underwent a heat treatment at 900° C. for 150 h. The microstructures of these two alloys are shown in FIG. 25. It can be observed that the alloy with 1 at. % Ni is a two-phase mixture of $\tau_{11}$ and a very small amount of $Al_{13}Fe_4$ phases, while the alloy with 2 at. % Ni is a $\tau_{11}$ single phase. Similarly to Mn, the addition of Ni destabilized the $Al_{13}Fe_4$ phase and higher amounts of the Ni addition demonstrated to be more effective for $\tau_{11}$ phase stabilization.

Conclusions

Experimental techniques through fabricating alloy and diffusion couple samples according to the preliminary results from computational calculations. These samples were then characterized using XRD, SEM, especially BSE imaging, EDS and EPMA. The main conclusions drawn from the present study are as follows:

The stable compositional range of the $\tau_{11}$ phase in the Al—Fe—Si ternary system was determined by alloy samples and EDS composition measurements, which is Al-(24.3-25.5)Fe-(8.2-10.8)Si at 800° C. and Al-(24.6-25.2)Fe-(9.6-11.0)Si at 950° C.

Nine elements of Co, Cu, Mn, Mo, Nb, Ni, Sn, Ti and Zn were firstly identified as quaternary candidate elements using computational approaches of data-mining of crystal structure databases, thermodynamic and DFT calculations.

Both SSDCs and SLDCs were made to extract the exact solubility of these nine quaternary alloying elements in the $\tau_{11}$ phase at 800° C. Cu, Mn, Mo, Nb, Ti and Sn were confirmed to have no solubility in $\tau_{11}$, while Co, Ni and Zn show a solubility of 6.6, 2.0 and 7.2 at. %, respectively.

Mn and Ni were found to be promising to destabilize the completing $Al_{13}Fe_4$ phase. Two alloys with nominal compositions of Al-20.0Fe-11.0Si-4.5Mn and Al-24.5Fe-8.2Si-2.0Ni (all in at. %) were confirmed to be the complete $\tau_{11}$ single phase at 800° C. and 900° C., respectively.

Composition Range of the $\tau_{11}$-$Al_4(Fe,Mn)_{1.7}Si$ Phase

Figures 26A, 26B:
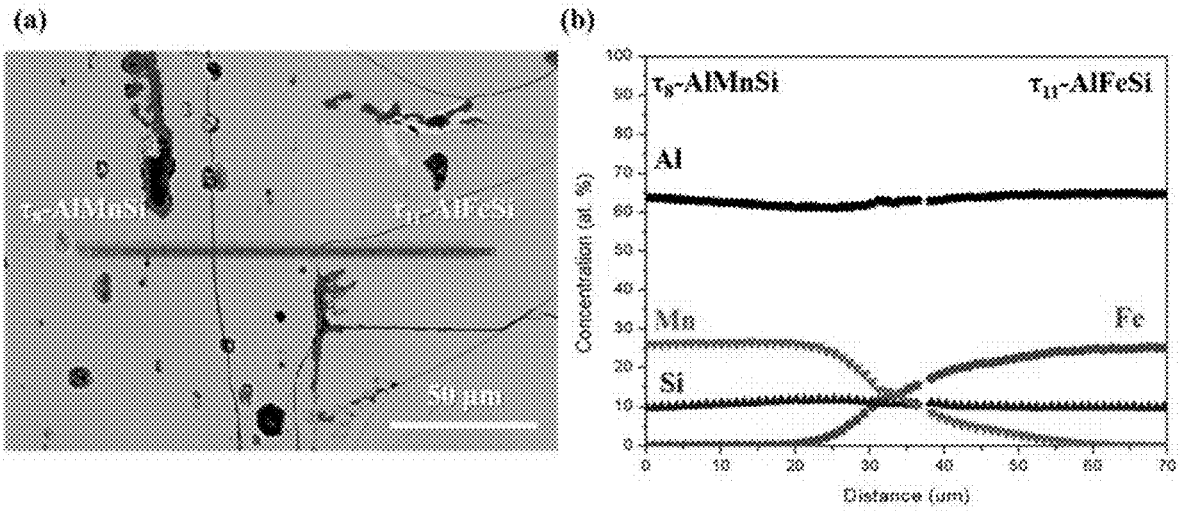
FIGS. 26(*a*)-(*b*) show (a) a SEM image taken from the Al—Mn—Si/Al—Fe—Si SSDC annealed at 800° C. for 3 weeks (672 h), showing the EPMA line scan location (red line right arrow) and (b) the measured composition profiles.

FIG. 26(*a*) shows an SEM BSE image taken from an Al—Fe—Si/Al—Mn—Si SSDC that was annealed at 800° C. for 3 weeks (672 h), showing the phase formation in the diffusion region. The SSDC is made out of an alloy with nominal composition $Al_{65.3}Fe_{24.5}Si_{10.2}$ and the second end member is a single phase $\tau_8$-$Al_9Mn_3Si$ alloy. The dark globular spots is porosity formed in the alloys during homogenization previous to the SSDC assembly and lines are cracks shown in the diffusion region, which are formed mainly during quenching and subsequent metallographic processes. An EPMA line scan with a step size of 2 μm was performed across the diffusion region. The line scan location is shown in FIG. 26(*a*) as a red line with the arrow indicating the scan direction. The measured composition profiles are plotted in FIG. 26(*b*), from which a compositional range of $\tau_{11}$ at 800° C. was measured to be Al (24-12)Fe (10-11)Si (1.5-14) Mn, all in at. %. In addition, the concentrations of Mn decrease at the same proportion the Fe concentration increase suggesting that Fe and Mn atoms substitute readily for each other and form a continuous solid solution between $\tau_{11}$ and $\tau_8$, while the Al and Si contents in the phase exhibit little change.

Figures 27A, 27B, 27C:
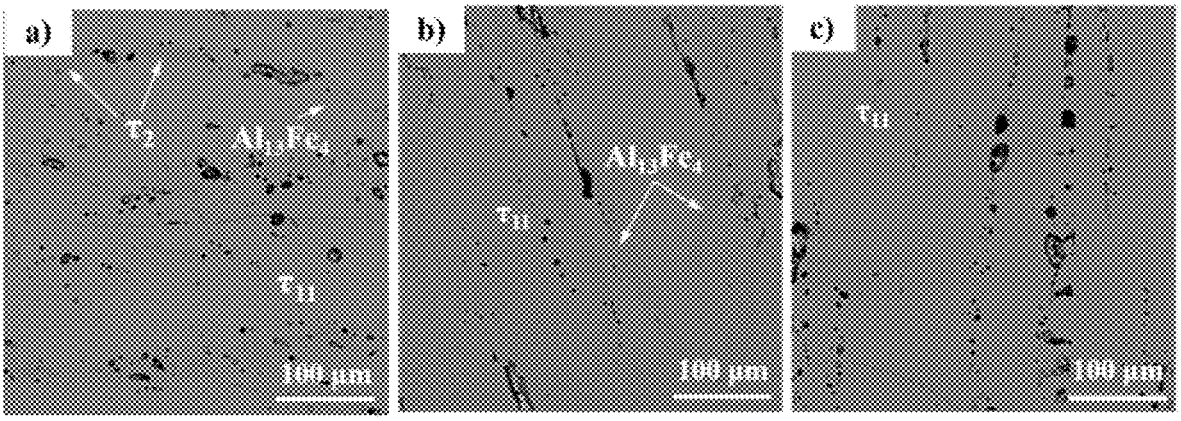
FIGS. 27(*a*)-(*c*) show SEM BSE images of Al—Fe—Si—Mn alloys annealed at 800° C. for 350 h with nominal compositions of (a) $Al_{64.5}Fe_{23}Si_{11}Mn_{1.5}$ (b) $Al_{67.5}Fe_{20}Si_{8}Mn_{4.5}$ and (c) $Al_{62.5}Fe_{20}Si_{13.0}Mn_{4.5}$.
Figure 28A:
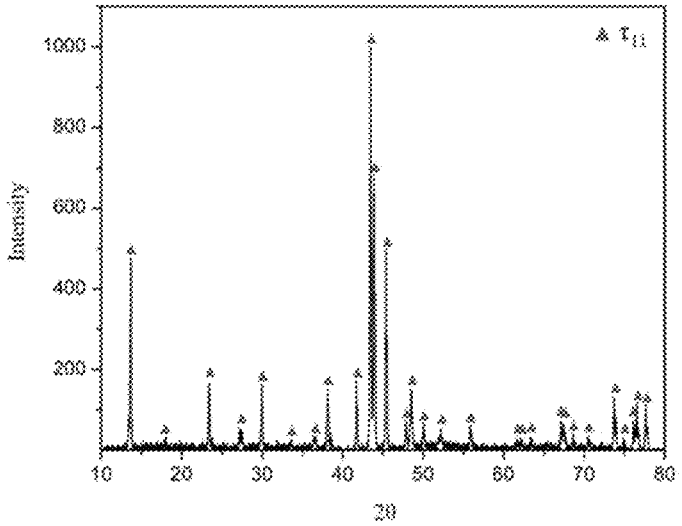
FIGS. 28(*a*)-(*b*) show XRD patterns obtained from Al—Fe—Si—Mn alloys equilibrated at 800° C. with the nominal composition of (a) $Al_{62.5}Fe_{19}Si_{13}Mn_{4.5}$ and (b) $Al_{64.5}Fe_{23}Si_{11}Mn_{1.5}$, where the characteristic peaks of $\tau_{11}$ were identified.
Figure 28B:
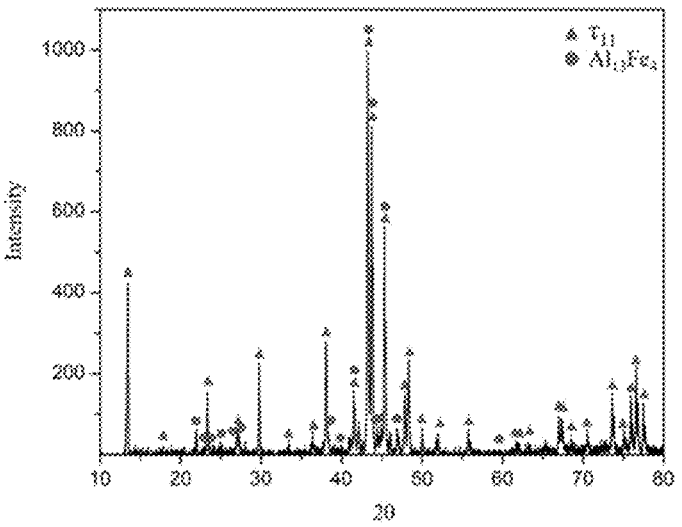

To validate the SSDC results and to determine the exact phase boundary of the $\tau_{11}$-$Al_4(Fe,Mn)_{1.7}Si$ phase, a series of Al—Fe—Si—Mn alloys were fabricated. FIGS. 27(*a-c*) show SEM BSE images of Al—Fe—Si—Mn that were annealed at 800° C. for 350 h, showing the representative microstructure of single-, two- and three-phase alloys. FIG. 27(*a*) shows a three-phase alloy with nominal composition of $Al_{64.5}Fe_{23}Si_{11}Mn_{1.5}$. In this alloy the binary phase $Al_{13}Fe_4$ and ternary phases $\tau_{11}$ and $\tau_{12}$ were identified. A characteristic two-phase microstructure ($\tau_{11}$ and $Al_{13}Fe_4$) of an alloy with a nominal composition of $Al_{67.5}Fe_{20}Si_8Mn_{4.5}$ is shown in FIG. 27(*b*), while FIG. 27(*c*) shows the SEM image of a $\tau_{11}$ single-phase alloy with a nominal composition of $Al_{61.5}Fe_{20}Si_{13.0}Mn_{4.5}$. Similarly, alloys with nominal composition $Al_{61.5}Fe_{20}Si_{13.0}Mn_{4.5}$, The phases present in the alloys were labeled based on the results from EPMA chemical composition analysis. XRD measurements confirmed the presence of $\tau_{11}$. The XRD patterns of selected equilibrated alloys were analyzed by comparing the diffraction patterns with the literature using the Match Software [58]. FIGS. 28(*a*)-(*b*) show two representative Al—Fe—Si—Mn alloys XRD patterns. FIG. 28(*a*) shows a typical XRD pattern obtained from single phase alloy, which was obtained from an alloy with the nominal composition of $Al_{64.5}Fe_{19}Si_{11.0}Mn_{4.5}$. FIG. 28(*b*) shows a typical XRD pattern obtained from an alloy with nominal composition of $Al_{64.5}Fe_{23}Si_{11.0}Mn_{1.5}$.

Table 2 lists the Al—Fe—Si—Mn alloys heat treated at 800° C. for 350 h, nominal concentrations and phases present and phases concentrations. In summary, single phase was confirmed in the alloys with nominal compositions of 3.5 to 14 at. % Mn and from 11 to 13 at. % Si. For Mn concentrations below 3.5 at. %, the equilibrated alloys showed a two- and three-phase microstructure. From these alloys, the composition range of $\tau_{11}$ at 800° C. was determined to be Al-(13.0-24.0)Fe-(9.1-12.8)Si-(13.7-1.7)Mn.

TABLE 2

List of the Al—Fe—Si—Mn alloys heat treated at 800° C. for 350 h, phases present and measured concentrations. All the compositions are shown in at. %.

| Nominal Composition (at %) | | | | | EPMA Composition (at %) | | | |
|---|---|---|---|---|---|---|---|---|
| Al | Fe | Si | Mn | Phases | Al | Fe | Si | Mn |
| 63.5 | 24.5 | 10.5 | 1.5 | $\tau_{11}$ | 64.1 | 24.0 | 10.1 | 1.7 |
| | | | | $Al_{13}Fe_4$ | 70.3 | 23.8 | 5.2 | 0.7 |
| | | | | $\tau_1$ | 30.8 | 36.0 | 31.8 | 1.4 |
| 64.5 | 22 | 11 | 2.5 | $\tau_{11}$ | 64.6 | 22.5 | 10.3 | 2.7 |
| | | | | $Al_{13}Fe_4$ | 69.7 | 23.1 | 6.1 | 1.1 |
| 64.5 | 21 | 11 | 3.5 | $\tau_{11}$ | 64.4 | 21.7 | 10.7 | 3.3 |
| 66.5 | 20 | 9 | 4.5 | $\tau_{11}$ | 66.1 | 19.7 | 9.1 | 5.1 |
| | | | | $Al_{13}Fe_4$ | 71.4 | 21.4 | 4.8 | 2.4 |
| 64.5 | 20 | 11 | 4.5 | $\tau_{11}$ | 64.1 | 20.5 | 10.9 | 4.6 |
| 61 | 23.5 | 11 | 4.5 | $\tau_{11}$ | 62.3 | 22.3 | 10.5 | 4.9 |
| | | | | $\tau_1$ | 30.8 | 33.4 | 31.2 | 4.6 |
| 64 | 18.5 | 13 | 4.5 | $\tau_{11}$ | 65.0 | 18.3 | 11.5 | 5.2 |
| | | | | $\tau_2$ | 59.9 | 19.8 | 18.8 | 1.6 |
| 62.5 | 20 | 13 | 4.5 | $\tau_{11}$ | 62.0 | 21.0 | 12.5 | 4.5 |
| 60 | 21.5 | 14 | 4.5 | $\tau_{11}$ | 61.4 | 21.2 | 12.8 | 4.5 |
| | | | | $\tau_3$ | 52.8 | 23.2 | 22.3 | 1.6 |
| | | | | $\tau_1$ | 26.3 | 32.0 | 36.0 | 5.7 |
| 55 | 24.5 | 16 | 4.5 | $\tau_{11}$ | 62.5 | 23.0 | 10.3 | 4.3 |
| | | | | $\tau_1$ | 31.3 | 33.3 | 30.4 | 5.0 |
| 64.5 | 19 | 11 | 5.5 | $\tau_{11}$ | 64.2 | 21.2 | 10.0 | 4.6 |
| 63.5 | 19 | 10.5 | 7 | $\tau_{11}$ | 64.7 | 18.7 | 10.3 | 6.4 |
| 63.5 | 12 | 10.5 | 14 | $\tau_{11}$ | 63.0 | 13.0 | 10.3 | 13.7 |

Figures 29A, 29B:
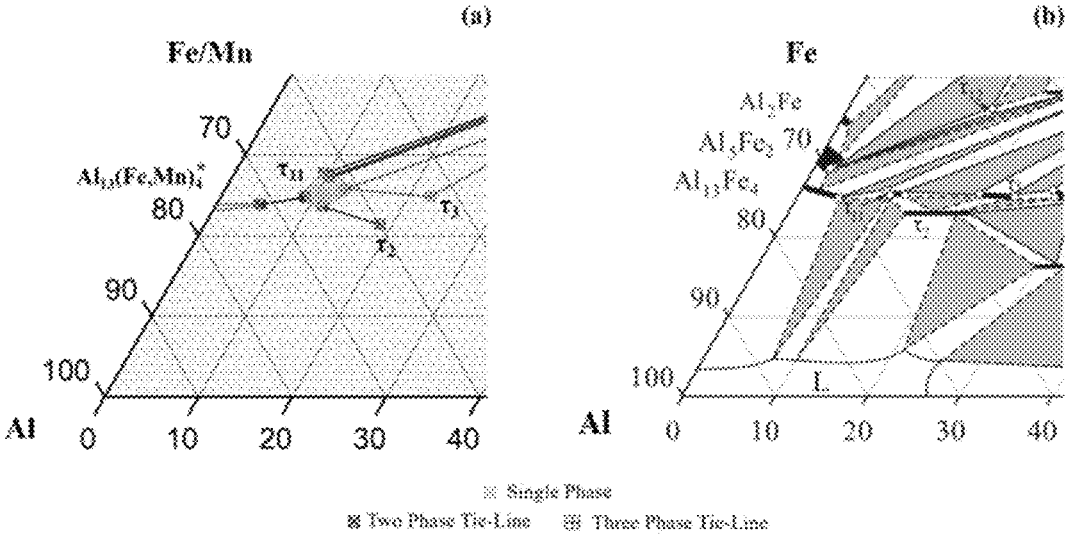
FIGS. 29(*a*)-(*b*) show (a) measured equilibrium compositions of $\tau_{11}$ and $Al_{13}Fe_4$ from the equilibrated alloys with ~4.5 at. % Mn, (b) 800° C. isotherm reported by Marker et al. [2] of the Al—Fe—Si ternary system.

FIGS. 29(*a*)-(*b*) compare the measured equilibrium compositions of the $\tau_{11}$ and $Al_{13}Fe_4$ phases from the alloys with ~4.5 at. % Mn to the 800° C. isotherm by Marker et al. [59]. It is observed that in the currently measured composition range of $\tau_{11}$-$Al_4(Fe,Mn)_{1.7}Si$ with ~4.5 at. % Mn is wider than the $\tau_{11}$-$Al_4Fe_{1.7}Si$ phase reported in the literature[59]-[62]. In addition, the solubility of Si and Mn in the $Al_{13}Fe_4$ phase was found to be up to 6.3 and 2.3 at. %.

In summary, the stability of $\tau_{11}$ with additions of Mn was systematically studied using SSDC techniques and equilibrated alloys. The experimental data reveals a solubility of Mn up to 2.3 at. % in $Al_{13}Fe_4$ phase and a measured compositional range of $\tau_{11}$-$Al_4(Fe,Mn)_{1.7}Si$ of Al (24.0-12.0)Fe (13.0-9.0)Si (1.5-14.0)Mn at 800° C.

It will be understood that certain features and subcombinations are of utility and may be employed without reference to other features and subcombinations. This is contemplated by and is within the scope of the claims.

Since many possible aspects may be made without departing from the scope thereof, it is to be understood that all matter herein set forth or shown in the accompanying drawings is to be interpreted as illustrative and not in a limiting sense.

Various modifications and variations can be made to the compounds, compositions and methods described herein. Other aspects of the compounds, compositions and methods described herein will be apparent from consideration of the specification and practice of the compounds, compositions and methods disclosed herein. It is intended that the specification and examples be considered as exemplary.

REFERENCES

[1] B. McKenzie. Who drives to work? Commuting by automobile in the United States: 2013, United States Census Bureau, ACS-32, 2015.

[2] E. Giovannetti. CAFE Standards and the federal gas tax: impact on private transit CO2 emissions, University of Iowa, 2018.

[3] United States Environmental Protection Agency. Light-duty automotive technology, carbon dioxide emissions, and fuel economy trends: 1975 Through 2016, EPA-420-R-16-010 (2016).

[4] United States Environmental Protection Agency. Final Determination on the Appropriateness of the Model Year 2022-2025 Light-Duty Vehicle Greenhouse Gas Emissions Standards under the Midterm Evaluation, EPA-420-R-17-001, 2017.

[5] National Research Council. Effectiveness and impact of corporate average fuel economy (CAFE) standards, National Academies Press, 2002.

[6] E. Ghassemieh. Materials in automotive application, state of the art and prospects, IntechOpen, 2011.

[7] A. Orłowicz, M. Mróz, M. Tupaj, A. Trytek. Materials used in the automotive industry, Archives of Foundry Engineering 15 (2015) 75-78.

[8] R. Rana, S. B. Singh. Automotive steels: design, metallurgy, processing and applications, Woodhead Publishing, 2016.

[9] C. M. Tamarelli. AHSS 101: The evolving use of advanced high strength steels for automotive applications, University of Michigan, 2011.

[10] The Aluminum Association. Automotive, http://www.aluminum.org/product-markets/automotive (Accessed Jul. 20, 2018).

[11] M. K. Kulekci. Magnesium and its alloys applications in automotive industry, Int J Adv Manuf Technol 39 (2008) 851-865.

[12] O. Faruk, J. Tjong, M. Sain. Lightweight and sustainable materials for automotive applications, CRC Press, 2017.

[13] A. A. Luo. Magnesium casting technology for structural applications, J Magnesium and Alloys 1 (2013) 2-22.

[14] R. Hussein, D. Northwood. Improving the performance of magnesium alloys for automotive applications, WIT Trans Built Evn 137 (2014) 531-544.

[15] R. Mitra. Structural intermetallics and intermetallic matrix composites, CRC Press, 2015.

[16] W. O. Soboyejo, T. Srivatsan. Advanced structural materials: properties, design optimization, and applications, CRC press, 2006.

[17] S. H. Whang, D. P. Pope, C. T. Liu. High temperature aluminides and intermetallics: proceedings of the second international ASM conference on high temperature aluminides and intermetallics, San Diego, California, USA, 1991.

[18] X. Li, A. Scherf, M. Heilmaier, F. Stein. The Al-rich part of the Fe—Al phase diagram, J Phase Equilib Diff 37 (2016) 162-173.

[19] Y. Liu, X. Chong, Y. Jiang, R. Zhou, J. Feng. Mechanical properties and electronic structures of Fe—Al intermetallic, Physica B 506 (2017) 1-11.

[20] C. T. Liu, R. W. Cahn, G. Sauthoff. Ordered intermetallics: physical metallurgy and mechanical behaviour, Springer Science & Business Media, 2012.

[21] M. C. Marker, B. Skolyszewska-Kühberger, H. S. Effenberger, C. Schmetterer, K. W. Richter. Phase equilibria and structural investigations in the system Al—Fe—Si, Intermetallics 19 (2011) 1919-1929.

[22] Z. Y. Liu, A. K. Sachdev. Rapidly solidified high-temperature aluminum iron silicon alloys. U.S. Patents 2017/0211168 A1, 2017.

[23] L. Yang, K. Hsu, B. Baughman, D. Godfrey, F. Medina, M. Menon, S. Wiener. Additive manufacturing of metals: the technology, materials, design and production, Springer, 2017.

[24] ASTM International. Standard terminology for additive manufacturing technologies, ASTM F2792-12a, 2012.

[25] WE. Frazier. Metal additive manufacturing: a review, J Mater Eng Perform 23 (2014) 1917-1928.

[26] S. H. Huang, P. Liu, A. Mokasdar, L. Hou. Additive manufacturing and its societal impact: a literature review, Int J Adv Manuf Technol 67 (2013) 1191-1203.

[27] W. Gao, Y. Zhang, D. Ramanujan, K. Ramani, Y. Chen, C. B. Williams, C. C. L. Wang, Y. C. Shin, S. Zhang, P. D. Zavattieri. The status, challenges, and future of additive manufacturing in engineering, Comput Aided Design 69 (2015) 65-89.

[28] D. D. Gu, W. Meiners, K. Wissenbach, R. Poprawe. Laser additive manufacturing of metallic components: materials, processes and mechanisms, Int Mater Rev 57 (2012) 133-164.

[29] K. V. Wong, A. Hernandez. A review of additive manufacturing, ISRN Mech Eng 2012 (2012).

[30] M. Qian, W. Xu, M. Brandt, H. Tang. Additive manufacturing and postprocessing of Ti-6Al-4V for superior mechanical properties, MRS Bull 41 (2016) 775-784.

[31] Y. Du, J. C. Schuster, Z.-K. Liu, R. Hu, P. Nash, W. Sun, W. Zhang, J. Wang, L. Zhang, C. Tang. A thermodynamic description of the Al—Fe—Si system over the whole composition and temperature ranges via a hybrid approach of CALPHAD and key experiments, Intermetallics 16 (2008) 554-570.

[32] U. Scipioni Bertoli, G. Guss, S. Wu, M. J. Matthews, J. M. Schoenung. In-situ characterization of laser-powder interaction and cooling rates through high-speed imaging of powder bed fusion additive manufacturing, Mater Design 135 (2017) 385-396.

[33] S. Gorsse, C. Hutchinson, M. Gouné, R. Banerjee. Additive manufacturing of metals: a brief review of the characteristic microstructures and properties of steels, Ti-6Al-4V and high-entropy alloys, Sci Technol Adv Mater 18 (2017) 584-610.

[34] C. Qiu, M. A. Kindi, A. S. Aladawi, I. A. Hatmi. A comprehensive study on microstructure and tensile behaviour of a selectively laser melted stainless steel, Sci Rep 8 (2018) 7785.

[35] A. Jain, S. P. Ong, G. Hautier, W. Chen, W D. Richards, S. Dacek, S. Cholia, D. Gunter, D. Skinner, G. Ceder. Commentary: The Materials Project: a materials genome approach to accelerating materials innovation, APL Mater 1 (2013) 011002.

[36] National Science and Technology Council. Materials Genome Initiative for Global Competitiveness, 2011.

[37] S. Gražulis, D. Chateigner, R. T. Downs, A. Yokochi, M. Quirós, L. Lutterotti, E. Manakova, J. Butkus, P. Moeck, A. Le Bail. Crystallography Open Database an open-access collection of crystal structures, J Appl Crystallogr 42 (2009) 726-729.

[38] S. Gražulis, A. Daškevič, A. Merkys, D. Chateigner, L. Lutterotti, M. Quiros, N. R. Serebryanaya, P. Moeck, R. T. Downs, A. Le Bail. Crystallography Open Database (COD): an open-access collection of crystal structures and platform for world-wide collaboration, Nucleic Acids Res 40 (2011) D420-D427.

[39] J.-O. Andersson, T. Helander, L. Höglund, P. Shi, B. Sundman. Thermo-Calc & DICTRA, computational tools for materials science, Calphad 26 (2002) 273-312.

[40] G. Kresse, J. Hafner. Ab initio molecular dynamics for liquid metals, Phys Rev B 47 (1993) 558.

[41] G. Kresse, J. Hafner. Ab initio molecular-dynamics simulation of the liquid-metalamorphous-semiconductor transition in germanium, Phys Rev B 49 (1994) 14251.

[42] G. Kresse, J. Furthmüller. Efficiency of ab-initio total energy calculations for metals and semiconductors using a plane-wave basis set, Comp Mater Sci 6 (1996) 15-50.

[43] G. Kresse, J. Furthmüller. Efficient iterative schemes for ab initio total-energy calculations using a plane-wave basis set, Phys Rev B 54 (1996) 11169.

[44] P. E. Blöchl. Projector augmented-wave method, Phys Rev B 50 (1994) 17953.

[45] G. Kresse, D. Joubert. From ultrasoft pseudopotentials to the projector augmented-wave method, Phys Rev B 59 (1999) 1758.

[46] J. P. Perdew, K. Burke, M. Ernzerhof. Generalized gradient approximation made simple, Phys Rev Lett 77 (1996) 3865.

[47] A. Jain, G. Hautier, C. J. Moore, S. P. Ong, C. C. Fischer, T. Mueller, K. A. Persson, G. Ceder. A high-throughput infrastructure for density functional theory calculations, Comp Mater Sci 50 (2011) 2295-2310.

[48] S. P. Ong, L. Wang, B. Kang, G. Ceder. Li—Fe—P—O2 phase diagram from first principles calculations, Chem Mater 20 (2008) 1798-1807.

[49] S. P. Ong, A. Jain, G. Hautier, B. Kang, G. Ceder. Thermal stabilities of delithiated olivine MPO4 (M=Fe, Mn) cathodes investigated using first principles calculations, Electrochem Commun 12 (2010) 427-430.

[50] K. Mathew, A. K. Singh, J. J. Gabriel, K. Choudhary, S. B. Sinnott, A. V. Davydov, F. Tavazza, R. G. Hennig. MPInterfaces: A materials project based Python tool for high-throughput computational screening of interfacial systems, Comp Mater Sci 122 (2016) 183-190.

[51] J.-C. Zhao. Methods for phase diagram determination, Elsevier, 2011.

[52] F. J. J. van Loo. Multiphase diffusion in binary and ternary solid-state systems, Prog Solid State Chem 20 (1990) 47-99.

[53] V. T. Witusiewicz, F. Sommer, E. J. Mittemeijer. Reevaluation of the Fe—Mn phase diagram, J Phase Equilib and Diff 25 (2004) 346-354.

[54] R. Thompson, J.-C. Zhao, K. Hemker. Effect of ternary elements on a martensitic transformation in β-NiAl, Intermetallics 18 (2010) 796-802.

[55] J.-C. Zhao, X. Zheng, D. G. Cahill. Thermal conductivity mapping of the Ni—Al system and the beta-NiAl phase in the Ni—Al—Cr system, Scripta Mater 66 (2012) 935-938.

[56] L. L. Zhu, C. W. Wei, New York Qi, L. Jiang, Z. P. Jin, J.-C. Zhao. Experimental investigation of phase equilibria in the Co-rich part of the Co—Al—X (X=W, Mo, Nb, Ni, Ta) ternary systems using diffusion multiples, J Alloy Compd 691 (2017) 110-118.

[57] B. Grushko, W. Kowalski, M. Surowiec. On the constitution of the Al—Co—Fe alloy system, J Alloy Compd 491 (2010) L5-L7.

[58] D. H. Putz and D. K. Brandenburg GbR, "Match!—Phase Identification from Powder Diffraction, Crystal Impact." Kreuzherrenstr102, 53227 Bonn, Germany.

[59] M. C. J. Marker, B. Skolyszewska-Kühberger, H. S. Effenberger, C. Schmetterer, and K. W. Richter, "Phase equilibria and structural investigations in the system Al—Fe—Si," *Intermetallics*, vol. 19, no. 12, pp. 1919-1929, 2011.

[60] F. Bosselet, S. Pontevichi, M. Sacerdote-Peronnet, and J. C. Viala, "Affinement expérimental de l'isotherme Al—Fe—Si à 1000 K," *J. Phys. IV*, vol. 122, pp. 41-46, 2004.

[61] V. Raghavan, "Al—Fe—Si (Aluminum-Iron-Silicon)," *J. Phase Equilibria Diffus.*, vol. 30, no. 2, pp. 184-188, 2009.

[62] N. V. German, N. V. Bel'skii, T. I. Yanson, and O. Zarechnyuk, "Crystal structure of the compound Fe1.7 Al4 Si," *Kristallografiya*, vol. 34, pp. 735-737, 1989.

What is claimed:

1. A composition comprising Al—Fe—Si—X quaternary intermetallic compound, wherein Al is in the amount of from about 60.0 atomic percent to about 70.0 atomic percent, Fe is in the amount of from about 13.0 atomic percent to about 30.0 atomic percent, and Si is in the amount of from about 5.0 atomic percent to about 20.0 atomic percent, wherein X is selected from Ni, Co, Cu, or Zn, wherein when X is Ni, the amount of Ni is greater than 2.0 atomic percent, wherein when X is Co, the amount of Co is from about 0.1 atomic percent to about 8.0 atomic percent, wherein when X is Zn, the amount of Zn is from about 0.1 atomic percent to about 10.0 atomic percent, and wherein when wherein X is Cu, the amount of Cu is from about 0.1 atomic percent to about 2.0 atomic percent.

2. The composition of claim 1, wherein Al—Fe—Si—X quaternary intermetallic compound is $\tau_{11}$-(66.1-65.3)Al-(19.3-24.1)Fe-(8.0-10.5)Si-(6.6-0.1)Co.

3. The composition of claim 1, wherein Al—Fe-Si-X quaternary intermetallic compound is $\tau_{11}$-(65.8)Al-(23.5)Fe-(9.7)Si-(1.1)Co and $\tau_{11}$-(66.1)Al-(22.4)Fe-(9.5)Si-(2.0)Co.

4. The composition of claim 1, wherein Al—Fe—Si—X quaternary intermetallic compound is $\tau_{11}$-(62.6-64.9)Al-(24.8-25.0)Fe-(4.7-10.0)Si-(7.9-0.2)Zn.

5. The composition of claim 1, wherein Al—Fe—Si—X quaternary intermetallic compound is $\tau_{11}$-(63.3-63.4)Al-(25.3-25.1)Fe-(11.3-10.7)Si-(0.1-0.9)Cu.

6. An article comprising a component comprising the composition of claim 1.

7. The article of claim 6, wherein the component is an automotive component, an aviation component, an aerospace component, or an implant.

8. The article of claim 6, wherein the component is made by a 3-D printer.

9. The composition of claim 1, wherein Al—Fe—Si—X quaternary intermetallic compound is $\tau_{11}$-(64.0)Al-(25.1)Fe-(10.7)Si-(0.2)Cu and $\tau_{11}$-(63.8)Al-(24.9)Fe-(10.6)Si-(0.7)Cu.

10. A composition produced by the process comprising melting Al, Fe, Si, and a metal X selected from the group consisting of Mn, Ni, Co, Cu, and Zn to produce a first composition, wherein Al is in the amount of from about 60.0 atomic percent to about 70.0 atomic percent, Fe is in the amount of from about 13.0 atomic percent to about 30.0 atomic percent, and Si is in the amount of from about 5.0 atomic percent to about 20.0 atomic percent, wherein when X is Ni, the amount of Ni is greater than 2.0 atomic percent.

11. The composition of claim 10, further comprising heating the first composition at a temperature of from about 700° C. to about 1,000° C. and from about 1 hour to about 600 hours.

12. The composition of claim 10, wherein X is selected from Mn, Ni, Co, Cu, or Zn, wherein when X is Ni, the amount of Ni is greater than 2.0 atomic percent, wherein when X is Co, the amount of Co is from about 0.1 atomic percent to about 8.0 atomic percent, wherein when X is Zn, the amount of Zn is from about 0.1 atomic percent to about 10.0 atomic percent, and wherein when wherein X is Cu, the amount of Cu is from about 0.1 atomic percent to about 2.0 atomic percent.

13. An article comprising a component comprising the composition of claim 10.

14. The article of claim 13, wherein the component is an automotive component, an aviation component, an aerospace component, or an implant.

15. The article of claim 13, wherein the component is made by a 3-D printer.

* * * * *